US011117690B2

(12) United States Patent
Yokota

(10) Patent No.: US 11,117,690 B2
(45) Date of Patent: Sep. 14, 2021

(54) CASE FORMING, PACKING, AND SEALING APPARATUS

(71) Applicant: ISHIDA CO., LTD., Kyoto (JP)

(72) Inventor: Yuji Yokota, Ritto (JP)

(73) Assignee: ISHIDA CO., LTD., Kyoto (JP)

( * ) Notice: Subject to any disclaimer, the term of this patent is extended or adjusted under 35 U.S.C. 154(b) by 86 days.

(21) Appl. No.: 16/285,207

(22) Filed: Feb. 26, 2019

(65) Prior Publication Data

US 2019/0263545 A1 Aug. 29, 2019

(30) Foreign Application Priority Data

Feb. 27, 2018 (JP) ..... JP2018-033024

(51) Int. Cl.
*B65B 5/02* (2006.01)
*B65B 5/06* (2006.01)
(Continued)

(52) U.S. Cl.
CPC ..... *B65B 5/024* (2013.01); *B31B 50/064* (2017.08); *B31B 50/07* (2017.08); *B31B 50/802* (2017.08); *B65B 5/06* (2013.01); *B65B 5/08* (2013.01); *B65B 7/20* (2013.01); *B65B 35/30* (2013.01); *B65B 35/56* (2013.01); *B65B 43/10* (2013.01); *B65B 43/145* (2013.01); *B65B 43/26* (2013.01)

(58) Field of Classification Search
CPC ..... B31B 50/064; B31B 50/07; B65B 5/024; B65B 5/106
USPC ..... 53/458, 542, 564, 566
See application file for complete search history.

(56) References Cited

U.S. PATENT DOCUMENTS 3,740,919 A * 6/1973 Heisler ..... B65B 43/285 53/446
4,332,124 A * 6/1982 Jaton ..... B65B 25/143 271/181
(Continued)

FOREIGN PATENT DOCUMENTS

CN 103332312 B 7/2015
CN 107399451 A 11/2017
(Continued)

OTHER PUBLICATIONS

The Office Action from the corresponding Australian Patent Application No. 2019201396 dated Aug. 16, 2019.
(Continued)

*Primary Examiner* — Thanh K Truong
*Assistant Examiner* — David G Shutty
(74) *Attorney, Agent, or Firm* — Shinjyu Global IP

(57) ABSTRACT

A case forming, packing, and sealing apparatus is disclosed. The case forming, packing, and sealing apparatus includes a cardboard box handling area and a product handling area. In the cardboard box handling area, case forming sheets including flatly collapsed cardboard boxes are erected into boxes that has openings which open in one direction, products are received into the boxes, and thereafter the openings are closed and sealed. In the product handling area, plural products are aligned and a predetermined quantity of the products are pushed in an accumulated state through the openings into the boxes. The cardboard box handling area and the product handling area are interconnected in a state in which they are mutually independently separable.

6 Claims, 19 Drawing Sheets

(51) Int. Cl.

| | |
|---|---|
| ***B65B 43/14*** | (2006.01) |
| ***B65B 7/20*** | (2006.01) |
| ***B65B 35/30*** | (2006.01) |
| ***B65B 43/10*** | (2006.01) |
| ***B65B 35/56*** | (2006.01) |
| ***B31B 50/06*** | (2017.01) |
| ***B65B 5/08*** | (2006.01) |
| ***B65B 43/26*** | (2006.01) |
| ***B31B 50/07*** | (2017.01) |
| ***B31B 50/80*** | (2017.01) |

(56) References Cited

U.S. PATENT DOCUMENTS

| | | | | |
|---|---|---|---|---|
| 4,517,791 | A * | 5/1985 | Focke | B65B 35/58 198/374 |
| 5,732,536 | A * | 3/1998 | Lin | B65B 5/106 53/245 |
| 6,913,568 | B2 * | 7/2005 | Frank | B31B 50/80 493/309 |
| 7,131,941 | B2 * | 11/2006 | Makar | 493/309 |
| 9,027,315 | B2 * | 5/2015 | Tsutsumi | B65B 43/305 53/564 |
| 9,334,070 | B2 * | 5/2016 | Till | B65B 35/56 |
| 10,093,440 | B2 * | 10/2018 | Johnson | B65B 43/39 |
| 2004/0138039 | A1 * | 7/2004 | Mazurek | B31B 50/80 493/309 |
| 2007/0197364 | A1 * | 8/2007 | Monti | B65B 43/305 493/316 |
| 2011/0232228 | A1 * | 9/2011 | Iwasa | B65B 35/44 53/147 |
| 2013/0283731 | A1 * | 10/2013 | Komp | B65B 59/005 53/268 |
| 2015/0298842 | A1 * | 10/2015 | Yokota | B65B 5/04 53/458 |

FOREIGN PATENT DOCUMENTS

| | | | |
|---|---|---|---|
| DE | 3110720 | A1 | 10/1982 |
| EP | 2829481 | A1 | 1/2015 |
| JP | 2000-313409 | A | 11/2000 |
| JP | 2005-145558 | A | 6/2005 |
| JP | 2005145558 | A * | 6/2005 |
| JP | 2015-157650 | A | 9/2015 |
| WO | 2011/119563 | A2 | 9/2011 |
| WO | 2018/168149 | A1 | 9/2018 |

OTHER PUBLICATIONS

The Search Report from the corresponding European Patent Application No. 19159247.6 dated May 23, 2019.

The Office Action from the corresponding Chinese Patent Application No. 201910099886.2 dated Oct. 10, 2020.

* cited by examiner

CASE FORMING, PACKING, AND SEALING APPARATUS

CROSS-REFERENCE TO RELATED APPLICATIONS

This application claims priority to Japanese Patent Application No. 2018-33024, filed Feb. 27, 2018. The contents of that application are incorporated by reference herein in their entirety.

TECHNICAL FIELD

The present disclosure relates to a case forming, packing, and sealing apparatus.

BACKGROUND ART

In recent years, automated case forming, packing, and sealing apparatus that open collapsed cardboard sheets to form cases, pack products in the cases, and thereafter seal and discharge the cases have become widespread. For example, JP-A No. 2005-145558 discloses a packing apparatus having an accommodating unit where collapsed case forming sheets are stacked in a horizontal state on top of each other and accommodated, a conveying unit that conveys the case forming sheets, a case forming unit that erects into boxes the case forming sheets conveyed by the conveying unit, a downward conveying unit that conveys the boxes erected by the case forming unit downward with the open portions of the boxes facing a lateral direction, and an inserting unit that inserts products from a lateral direction into the boxes conveyed by the downward conveying unit.

BRIEF SUMMARY

However, the above-described packing apparatus has a configuration where the collapsed case forming sheets are plurally stacked in a horizontal state on top of each other and accommodated, so the quantity of case forming sheets that can be stacked on top of each other is limited because the case forming sheet stacked at the very top is extracted one at a time. Consequently, any case forming sheet that exceeds the allowable quantity must be accommodated in back and the installation area of the accommodating unit increases.

In contrast, JP-A No. 2015-157650 discloses a packing apparatus where the case forming sheets are stacked upright against each other, with the portions that will form the openings facing sideways, so the direction of the box erecting process and the products packing direction are orthogonal to each other. Consequently, there is less flexibility to organize the layout, such as being unable to construct a unidirectional manufacturing line.

It is a problem of the present disclosure to provide a case forming, packing, and sealing apparatus that can inhibit an increase in its installation area while increasing the flexibility to organize the layout of the manufacturing line.

A case forming, packing, and sealing apparatus pertaining to a first aspect of the disclosure includes a cardboard box handling area and a product handling area. In the cardboard box handling area, case forming sheets comprising flatly collapsed cardboard boxes are erected into boxes that open in one direction, products are received into the boxes, and thereafter the openings are closed and sealed. In the product handling area, plural products are aligned and a predetermined quantity of the products are pushed in an accumulated state through the openings into the boxes. The cardboard box handling area and the product handling area are interconnected in a state in which they are mutually independently separable.

In this case forming, packing, and sealing apparatus, the cardboard box handling area and the product handling area can be completely separated from each other, so it becomes easy to organize the layout and the layout can be changed in conformity to production realities, which also contributes to inhibiting an increase in the installation area of the apparatus overall.

A case forming, packing, and sealing apparatus pertaining to a second aspect of the disclosure is the case forming, packing, and sealing apparatus pertaining to the first aspect, wherein the cardboard box handling area has an accommodating unit, a case forming unit, a first posture changing unit, a product receiving unit, a second posture changing unit, and a case sealing unit. In the accommodating unit, the case forming sheets are arranged and accommodated in such a way that their openings face up when the case forming sheets are opened. The case forming unit moves the case forming sheets upward one at a time, opens the case forming sheets into a square tubular shape, and thereafter closes bottom sides of the opened case forming sheets to form boxes that open upward. The first posture changing unit changes the posture of the boxes to a first posture in which the openings of the boxes face the product handling area. The product receiving unit lowers the boxes in the first posture and receives the products into the boxes. The second posture changing unit changes the posture of the boxes so that the openings of the boxes in the first posture face up. The case sealing unit closes and seals the openings of the boxes.

For example, in a configuration where the case forming sheets are accommodated in a horizontal state, if even one case forming sheet exceeds the allowable quantity, the case forming sheet must be accommodated in back, and so an installation area corresponding to the area of the case forming sheets must be additionally ensured.

In contrast, in this case forming, packing, and sealing apparatus, the case forming sheets are arranged and accommodated in such a way that their openings face up when the case forming sheets are opened, and thus the height of the case forming sheets stocked in the accommodating unit is unchanging, so basically there is no need to limit the quantity of case forming sheets accommodated, and even when the case forming sheets are restocked, the case forming sheets just extend backward a length equal to the thickness dimension of the case forming sheets multiplied by the restock quantity.

A case forming, packing, and sealing apparatus pertaining to a third aspect of the disclosure is the case forming, packing, and sealing apparatus pertaining to the second aspect, wherein the first posture changing unit rotates the boxes by 90° in the conveyance direction.

In this case forming, packing, and sealing apparatus, the cardboard boxes switch to a posture in which they open toward the conveyance direction, so by supplying the products toward the openings of the boxes, the products can be loaded sideways into the boxes.

A case forming, packing, and sealing apparatus pertaining to a fourth aspect of the disclosure is the case forming, packing, and sealing apparatus pertaining to the second aspect, wherein the conveyance direction when the case forming unit forms the boxes and the conveyance direction when the case sealing unit seals the openings of the boxes are mutually opposite directions.

In this case forming, packing, and sealing apparatus, by giving the apparatus a hierarchical line configuration where, for example, the case forming unit is positioned on a second level and the case sealing unit is positioned on a first level, the installation area of the cardboard box handling area can be reduced.

A case forming, packing, and sealing apparatus pertaining to a fifth aspect of the disclosure is the case forming, packing, and sealing apparatus pertaining to the second aspect, wherein the product handling area has a product aligning unit and a product inserting unit. The product aligning unit conveys the products in front of the boxes lowered in the first posture while performing an accumulating operation that aligns the products in such a way that parts of each of the products lie on top of parts of adjacent products in their thickness direction. The product inserting unit pushes the products that have been accumulated into the boxes in the first posture.

A case forming, packing, and sealing apparatus pertaining to a sixth aspect of the disclosure is the case forming, packing, and sealing apparatus pertaining to the second aspect, wherein the case forming unit, the first posture changing unit, the product receiving unit, the second posture changing unit, and the case sealing unit are supported by a common frame.

This case forming, packing, and sealing apparatus is an all-in-one machine, has a small footprint, and also has a good visual appearance.

Advantageous Effects of Invention

In the case forming, packing, and sealing apparatus pertaining to the disclosure, the cardboard box handling area and the product handling area can be completely separated from each other, so it becomes easy to organize the layout and the layout can be changed in conformity to production realities, which also contributes to inhibiting an increase in the installation area of the apparatus overall.

DETAILED DESCRIPTION

An embodiment of the disclosure will be described below with reference to the drawings. It will be noted that the following embodiment is a specific example of the disclosure and is not intended to limit the technical scope of the disclosure.

(1) Configuration of Packing System 1

Figure 1:
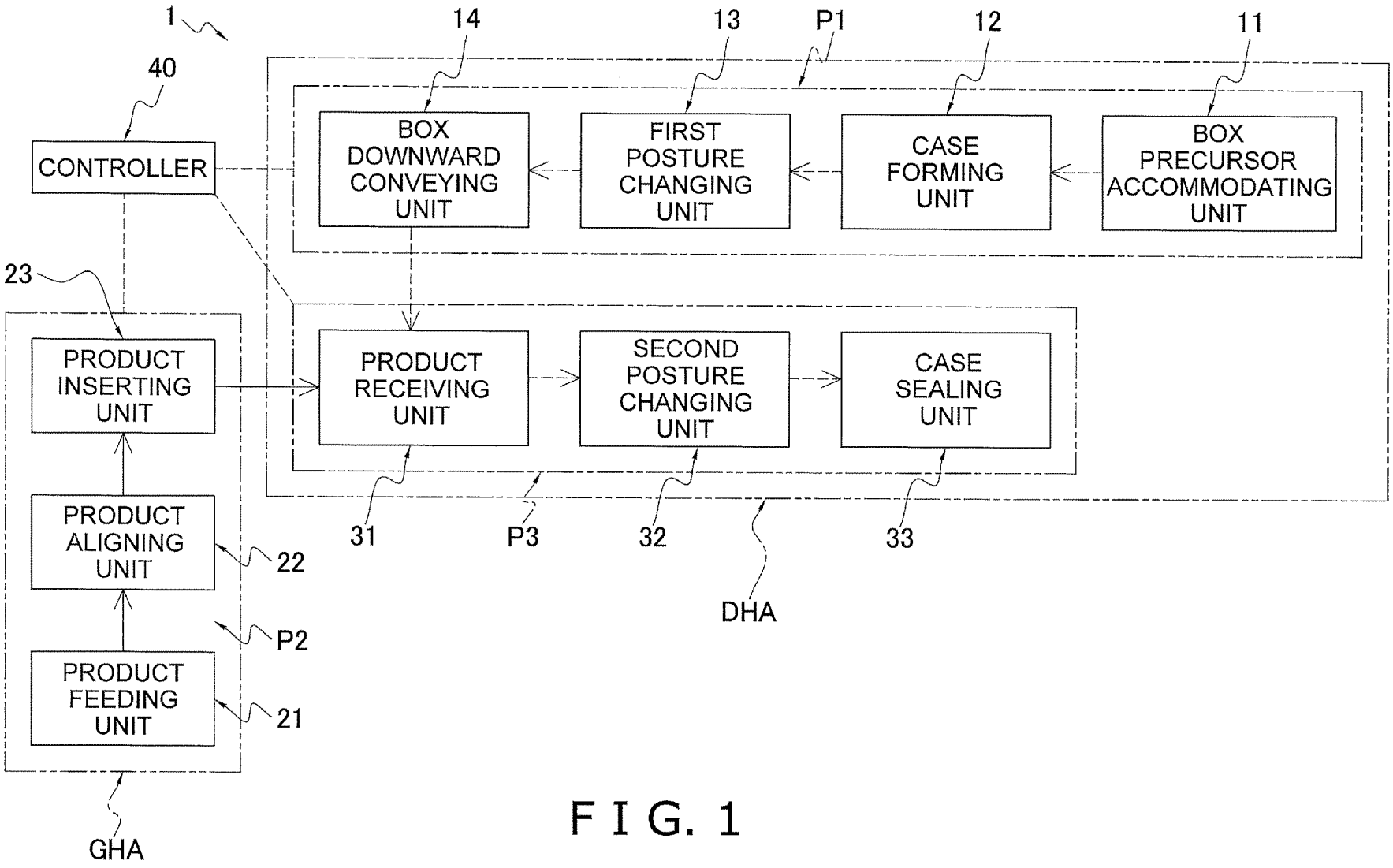
FIG. 1 is a block diagram of a packing system equipped with a case forming, packing, and sealing apparatus pertaining to an embodiment of the disclosure.

FIG. 1 is a block diagram of a packing system 1 equipped with a case forming, packing, and sealing apparatus pertaining to an embodiment of the disclosure. Furthermore, FIG. 2A is a perspective view showing the configuration of the packing system, and FIG. 2B is a perspective view showing a flow of cardboard boxes B and products G in the packing system 1.

Figure 2A:
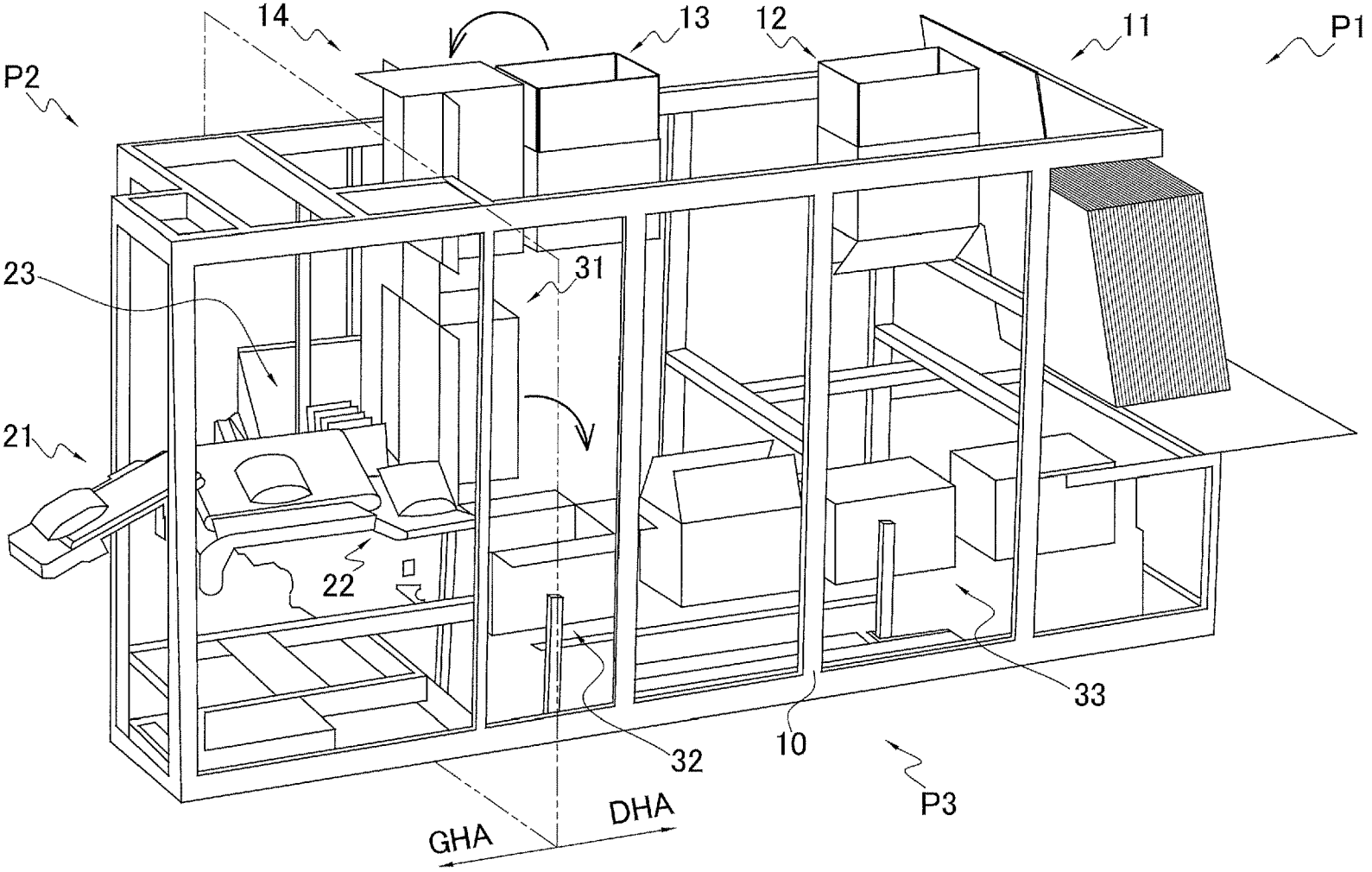
FIG. 2A is a perspective view showing the configuration of the packing system.
Figure 2B:
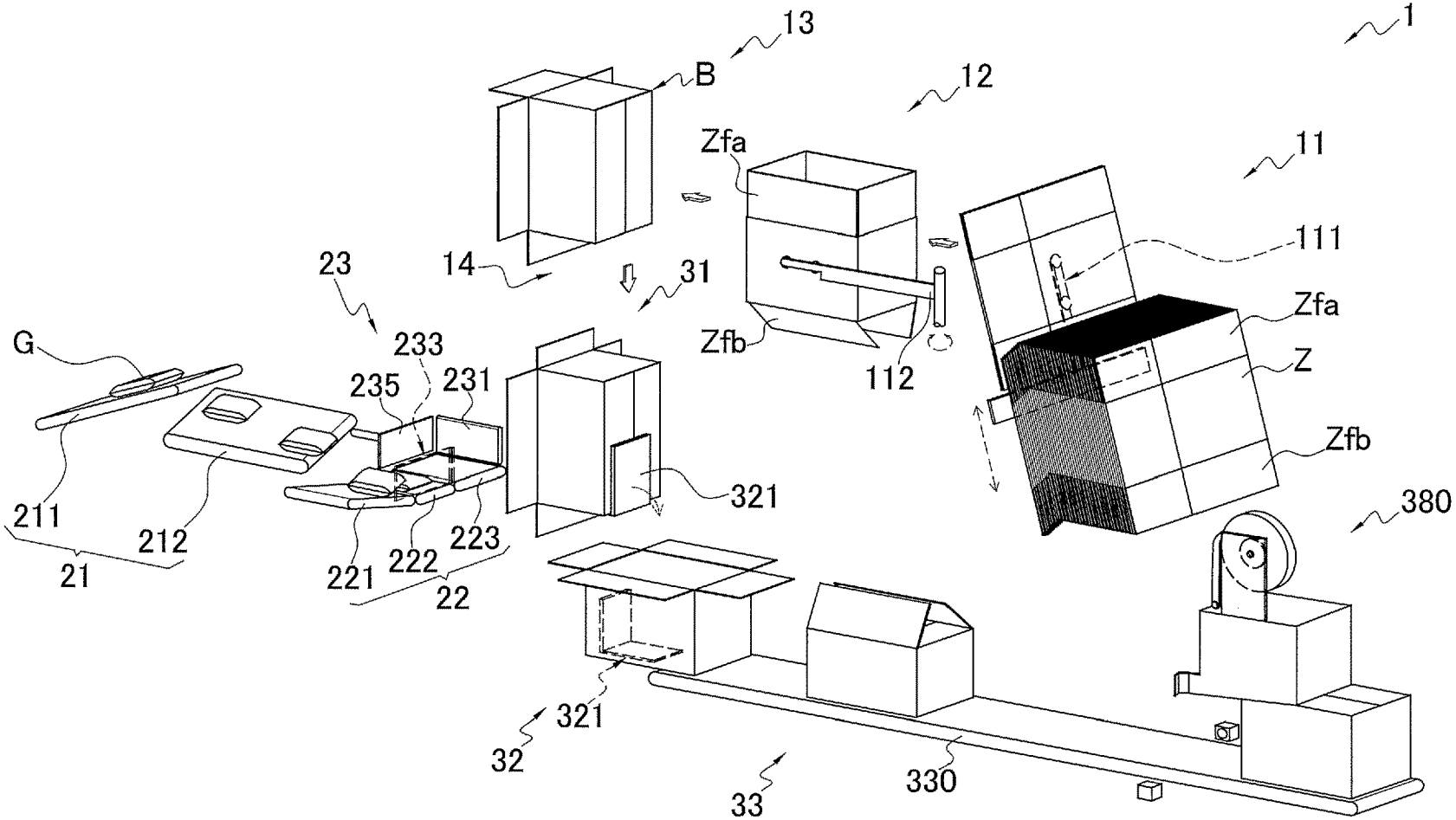
FIG. 2B is a perspective view showing a flow of cardboard boxes and products in the packing system.

In FIG. 1 and FIG. 2A, the packing system 1 is a system that packs a fixed number of bagged products (products G)

such as snack foods, for example, in an aligned state and in multiple layers into cardboard boxes B.

As shown in FIG. 1 and FIG. 2A, the packing system 1 comprises a cardboard box handling area DHA and a product handling area GHA that are interconnected in a state in which they are mutually independently separable. The cardboard box handling area DHA includes two processes, a case forming process P1 and a packing process P3. The product handling area GHA includes a product aligning process P2.

That is, in the packing system 1, because the cardboard box handling area DHA and the product handling area GHA are interconnected, the three processes of the case forming process P1, the product aligning process P2, and the packing process P3 work together.

The case forming process P1 is a process of erecting sheet-like cardboard box precursors Z into cardboard boxes B and conveying the cardboard boxes B to a packing position. The case forming process P1 is configured by a box precursor accommodating unit 11, a case forming unit 12, a first posture changing unit 13, and a box downward conveying unit 14.

The product aligning process P2 is a process of feeding to a predetermined position the products G supplied from an upstream process, aligning a fixed number of the products G so that adjacent products partially lie on top of each other, and conveying the fixed number of products G to the packing position. The product aligning process P2 is configured by a product feeding unit 21, a product aligning unit 22, and a product inserting unit 23.

The packing process P3 is a process of packing, into the cardboard boxes B that have been conveyed thereto from the case forming process P1, the fixed quantity of products G that have finished being aligned in the product aligning process P2, closing the boxes, and conveying the boxes to a box discharge position. The packing process P3 is configured by a product receiving unit 31, a second posture changing unit 32, and a case sealing unit 33.

The packing system 1 performs multilayer packing of the products G into the cardboard boxes B, and the posture of the products G inside the boxes B is a "standing posture." That is, the standing posture is a posture where, when the openings of the boxes B face up, the front sides and the back sides of the products G face sideways, the upper and lower end portions of the products G face up and down, and the left and right side portions of the products G face sideways.

Furthermore, as shown in FIG. 2A and FIG. 2B, the cardboard box handling area DHA has a two-level structure, and the case forming process P1 and the packing process P3 are supported by a common frame 10. The case forming process P1 occupies the second-level portion, and the packing process P3 occupies the first-level portion.

In order to realize this two-level structure, the conveyance direction of the cardboard boxes B from the erection of the cardboard boxes B by the case forming unit 12 to the box downward conveying unit 14 and the conveyance direction of the cardboard boxes B up to when the openings of the cardboard boxes B that have been packed the products G are sealed by the case sealing unit 33 are mutually opposite directions.

(2) Detailed Configuration of Case Forming Process P1

As shown in FIG. 2B, the case forming process P1 is configured by the box precursor accommodating unit 11 that introduces the cardboard box precursors Z to the packing system 1, the case forming unit 12 that erects the cardboard boxes B, the first posture changing unit 13 that rotates the cardboard boxes B by 90° about a horizontal axis orthogonal to the conveyance direction, and the box downward conveying unit 14 that conveys downward the cardboard boxes B that have been switched to a first posture.

(2-1) Box Precursor Accommodating Unit 11

The box precursor accommodating unit 11, as shown in FIG. 2B, picks one at a time and transports upward the cardboard box precursor Z at the very front of the cardboard box precursors Z stacked in a supply position, rotates the transported cardboard box precursor Z by 90° about a vertical axis, and opens it into a tubular shape.

The cardboard box precursors Z are placed in the supply position by a worker. The cardboard box precursors Z are collapsed with their flaps Zf open and are stacked in a horizontal direction in a posture in which the flaps Zf are positioned in the vertical direction. It will be noted that for convenience of description the flaps Zf on the top surface side will be called top flaps Zfa and the flaps Zf on the bottom surface side will be called bottom flaps Zfb.

The upward transport of the cardboard box precursors Z is performed by a lift mechanism 111. When all the cardboard box precursors Z in the supply position run out, a detection sensor (not shown in the drawings) sends a detection signal to a controller 40 (see FIG. 1).

Furthermore, the rotation of the cardboard box precursors Z about the vertical axis is realized by sucking and holding, with suckers, the side surfaces of the cardboard box precursors Z with a sucking and rotating mechanism 112 and rotating the sucking and rotating mechanism 112 90° about the vertical axis.

(2-2) Case Forming Unit 12

The case forming unit 12 conveys in a horizontal direction the cardboard box precursors Z that have been opened into a tubular shape and at the same time folds and tapes the bottom flaps Zfb of the cardboard box precursors Z to thereby erect the cardboard boxes B in a state in which the top flaps Zfa are open.

(2-3) First Posture Changing Unit 13

The first posture changing unit 13 rotates the cardboard boxes B by 90° in the conveyance direction. More specifically, the first posture changing unit 13 rotates the cardboard boxes B 90° about a horizontal axis orthogonal to the conveyance direction to thereby change the posture of the cardboard boxes B to a posture (hereinafter called a first posture) in which the openings and the top flaps Zfa of the cardboard boxes B are in the same vertical plane. When the cardboard boxes 13 are in the first posture, the openings face the product handling area GHA.

(2-4) Box Downward Conveying Unit 14

The box downward conveying unit 14 conveys downward the cardboard boxes B that have been switched to the first posture. That is, the box downward conveying unit 14 moves the cardboard boxes B downward with the openings of the cardboard boxes B kept facing the product handling area GHA.

(3) Detailed Configuration of Product Aligning Process P2

Disposed upstream of the product aligning process P2 in terms of the flow of the products G in the packing system 1 are a weigher, a bag-making and packaging machine, and the like not shown in the drawings. Only products G that have passed, for example, weight, seal, and contamination inspections in the upstream process are supplied to the product aligning process P2 in the packing system 1.

The product aligning process P2 is configured by the product feeding unit 21 that accepts the products G and conveys them to a predetermined position, the product aligning unit 22 that aligns the products G supplied from the product feeding unit 21, and the product inserting unit 23 that accumulates and pushes out the aligned products G.

(3-1) Product Feeding Unit 21

The product feeding unit 21 has a product introducing conveyor 211 and a feeding conveyor 212. The product introducing conveyor 211 receives, downstream of the process that performs, for example, the weight, seal, and contamination inspections, the supply of the products G that have passed the inspections and leads those products G to the feeding conveyor 212.

The feeding conveyor 212 conveys to the product aligning unit 22 the products G conveyed thereto from the product introducing conveyor 211.

Figure 3:
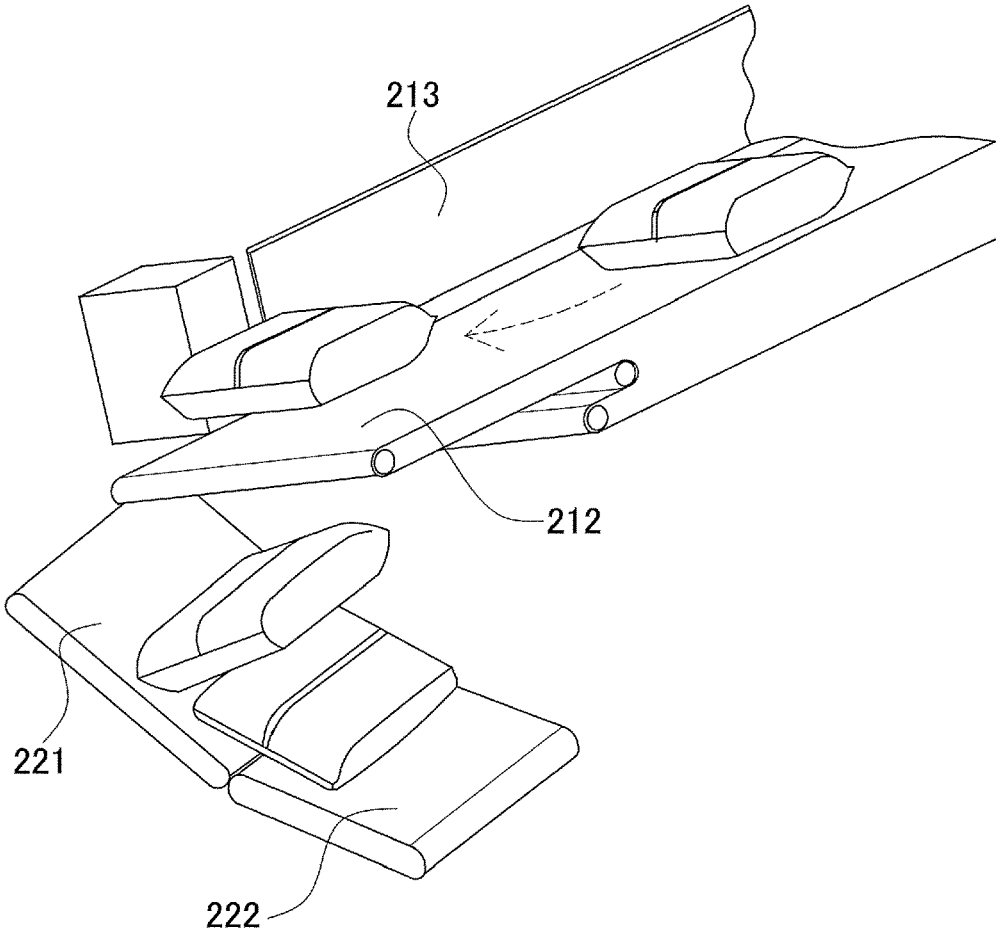
FIG. 3 is a perspective view showing the arrangement of a feeding conveyor, a first aligning conveyor, and a second aligning conveyor.

FIG. 3 is a perspective view showing the arrangement of the feeding conveyor 212, a first aligning conveyor 221, and a second aligning conveyor 222. In FIG. 3, the conveyance surface of the feeding conveyor 212 is inclined with respect to a horizontal plane, and a support wall 213 that supports and prevents the products G from falling off and guides the products G in the conveyance direction is provided on the inclination direction lower side end of the conveyance surface. The products G that move on the inclination direction upper side of the conveyance surface receive a component force of the force of gravity along the inclination direction, so the products G slide down toward the support wall 213 while moving and thereafter move along the support wall 213.

(3-2) Product Aligning Unit 22

The product aligning unit 22 has the first aligning conveyor 221, the second aligning conveyor 222, and a third aligning conveyor 223. The product aligning unit 22 is a unit that conveys the products G to a predetermined position while performing an accumulating operation with respect to the products G. The product aligning unit 22 is particularly suited to the accumulation of bag packages, so it can also be used independently as a package accumulating device.

(3-2-1) First Aligning Conveyor 221

The first aligning conveyor 221, in order to receive the products G that drop thereto from the feeding conveyor 212, has one end set in a lower position than the height of the distal end portion of the feeding conveyor 212 and has the other end set in the height position of the second aligning conveyor 222.

It will be noted that it is preferred that the distal end portion of the feeding conveyor 212 be positioned in the space directly above the product placement surface of the first aligning conveyor 221. Here, the product placement surface is the surface—of the conveyance surface of the first aligning conveyor 221—that waits to receive the products G that drop thereto.

Additionally, each time the first aligning conveyor 221 catches one product G, it conveys the product G a fixed distance (pitch L) toward the second aligning conveyor 222. This is because it is necessary to vacate the landing position before the next product G drops thereto because the position where the first aligning conveyor 221 catches the products G is the same. For that reason, the product G moves the fixed distance (pitch L) closer to the second aligning conveyor 222 from the position to which it dropped.

Part of the product G that drops thereafter lands on the first aligning conveyor 221, while the remaining part leans against the preceding product G and becomes inclined. This operation of aligning plural products G in such a way that parts of each of the products G lie on top of parts of adjacent products G in their thickness direction is called an accumulating operation.

Figure 4A:
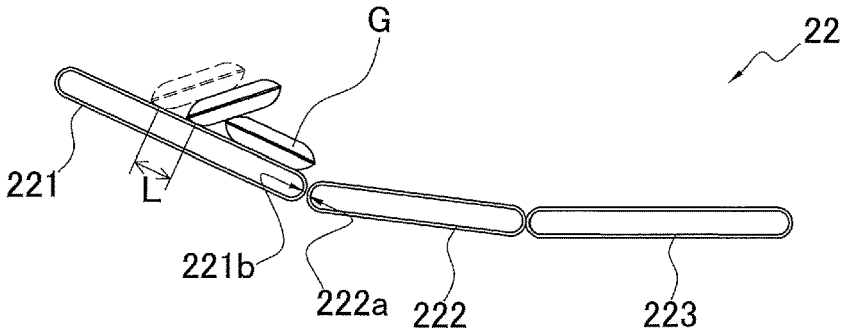
FIG. 4A is a front view of a product aligning unit as viewed from a horizontal direction orthogonal to a conveyance direction of a group of products in the middle of alignment on the first aligning conveyor.

FIG. 4A is a front view of the product aligning unit 22. In FIG. 4A, the product G at the front that was dropped first on the first aligning conveyor 221 has a subsequent product G partially lying on top of it, and thereafter another subsequent product G comes to lie on top of that subsequent product G to form a line.

In a case where, for example, the product aligning unit 22 aligns N=5 products G as a group, the product G at the front is ahead a length of 4L from the position where the product G at the rear lands, so in the present embodiment at least the product G at the front of the line arrives on the second aligning conveyor 222.

(3-2-2) Second Aligning Conveyor 222

Figure 4B:
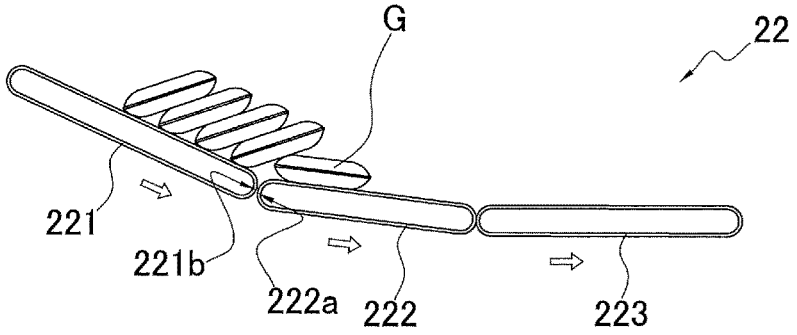
FIG. 4B is a front view of the product aligning unit when the product at the front of the aligned group of products has moved onto the second aligning conveyor.

FIG. 4B is a front view of the product aligning unit 22 when the product G at the front of the aligned groups of products G has moved onto the second aligning conveyor 222. In FIG. 4B, after the product G at the rear of the line lands on the first aligning conveyor 221, the first aligning conveyor 221, the second aligning conveyor 222, and the third aligning conveyor 223 simultaneously perform a conveying operation in the same direction. For that reason, the N-number of the products G aligned in a line on the first aligning conveyor 221 and the second aligning conveyor 222 move in unison toward the third aligning conveyor 223 and advance on the third aligning conveyor 223.

As shown in FIG. 4A and FIG. 4B, a conveyance direction downstream end 221*b* of the first aligning conveyor 221 and a conveyance direction upstream end 222*a* of the second aligning conveyor 222 oppose each other.

(3-2-2-1) First State of Second Aligning Conveyor 222

Here, the state in which the downstream end 221*b* of the first aligning conveyor 221 and the upstream end 222*a* of the second aligning conveyor 222 oppose each other is a state in which the downstream end 221*b* of the first aligning conveyor 221 and the upstream end 222*a* of the second aligning conveyor 222 are close enough to each other that the conveyance surface of the first aligning conveyor 221 and the conveyance surface of the second aligning conveyor 222 form a substantially continuous conveyance surface. This state is a first state.

In this first state, it is preferred that the gap between the downstream end 221*b* of the first aligning conveyor 221 and the upstream end 222*a* of the second aligning conveyor 222 be within 10 mm.

As shown in FIG. 4A and FIG. 413, each time the first aligning conveyor 221 catches one product G, it repeats the operation of conveying that product G the fixed distance (pitch L) toward the second aligning conveyor 222, and when the last product G comes onto the first aligning conveyor 221, namely, when one line's worth of a group of products is reached, the first aligning conveyor 221 performs a conveying operation at a longer pitch than the fixed distance (pitch L) only at that time because the group of products G must be discharged from the first aligning conveyor 221. At the same time, the second aligning conveyor 222 and the third aligning conveyor 223 also perform a conveying operation at the same speed.

Figure 4C:
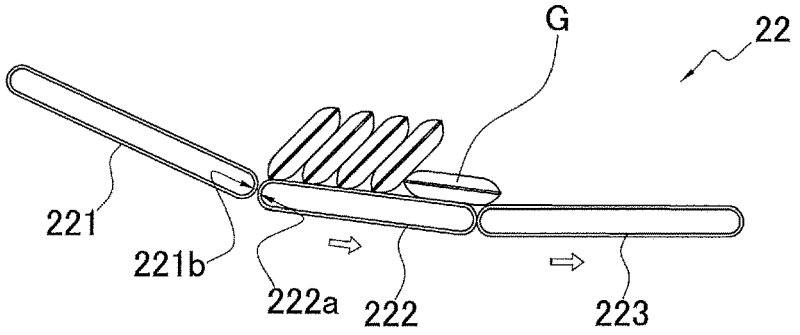
FIG. 4C is a front view of the product aligning unit after the aligned group of products has completely transferred to the second aligning conveyor.

FIG. 4C is a front view of the product aligning unit 22 after the aligned group of products G has completely transferred to the second aligning conveyor 222. In FIG. 4C, just the first aligning conveyor 221, upon ending the longer pitch conveying operation, decelerates, stops, and prepares to catch the next group of products G. At this time, the second aligning conveyor 222 and the third aligning conveyor 223 convey the group of products G handed over from the first aligning conveyor 221.

In a case where the products G are small bag products and many of them can be placed on the first aligning conveyor 221, or in a case where the conveyance speed is slow, the first state shown in FIG. 4A, FIG. 4B, and FIG. 4C is employed as the posture of the second aligning conveyor 222.

(3-2-2-2) Second State of Second Aligning Conveyor 222

However, in a case where the products G are large bag products and the conveyance speed is fast to increase production capacity and the second aligning conveyor 222 and the third aligning conveyor 223 perform a conveying operation except for when the products are inserted, there is the concern that when the second aligning conveyor 222 is conveying a preceding group of products the product at the front of the subsequent group of products will come into contact with the second aligning conveyor 222 and be pulled onto the second aligning conveyor 222.

Therefore, while the second aligning conveyor 22 is performing the conveying operation, the controller 40 switches the second aligning conveyor 222 to a second state, which is a state in which the position of the upstream end 222*a* of the second aligning conveyor 222 is lower than it is in the first state with respect to the downstream end 221*b* of the first aligning conveyor 221.

Figure 4D:
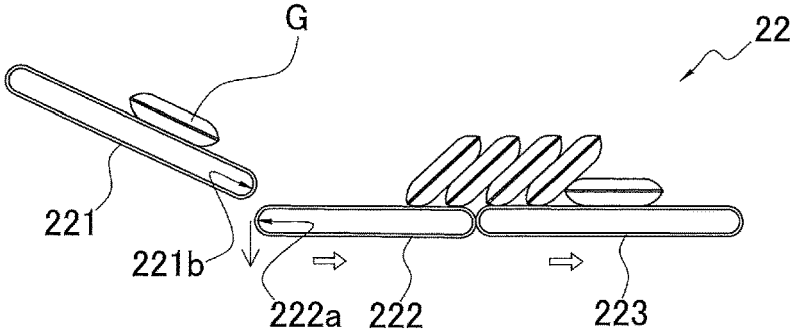
FIG. 4D is a front view of the product aligning unit when the second aligning conveyor is in a second state.
Figure 4E:
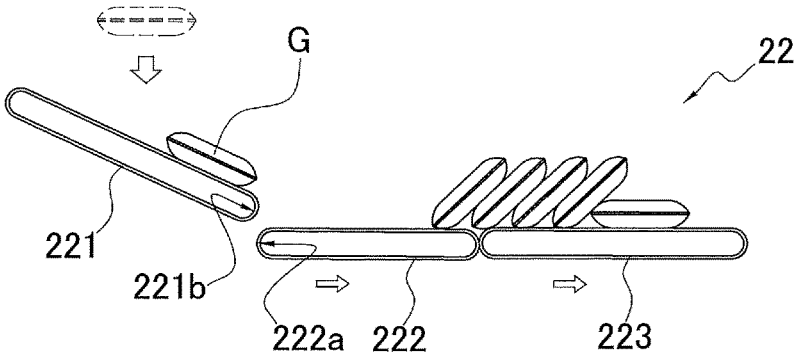
FIG. 4E is a front view of the product aligning unit when the second aligning conveyor is in the second state.
Figure 4F:
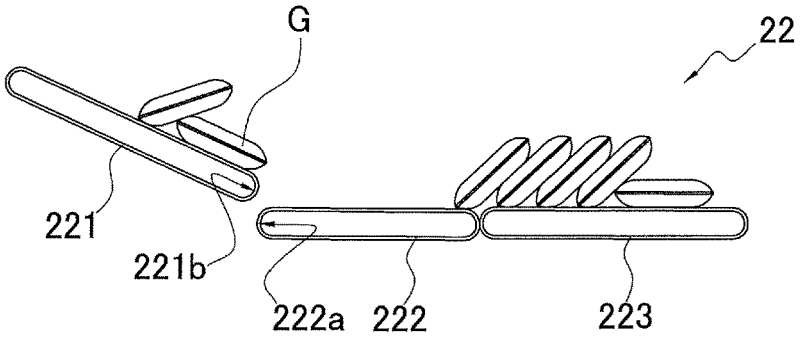
FIG. 4F is a front view of the product aligning unit when the second aligning conveyor is in the second state.

FIG. 4D, FIG. 4E, and FIG. 4F are front views of the product aligning unit 22 when the second aligning conveyor 222 is in the second state. In FIG. 4D, FIG. 4E, and FIG. 4F, a product G on the conveyance surface of the first aligning conveyor 221 is shown moving closer to the second aligning conveyor 222.

In FIG. 4D, FIG. 4E, and FIG. 4F, in the second state the upstream end 222*a* of the second aligning conveyor 222 is lowered in the direction of the arrow until the conveyance surface of the second aligning conveyor 222 is lower than the downstream end 221*b* of the first aligning conveyor 221.

In control terms, the controller 40 lowers the upstream end 222*a* of the second aligning conveyor 222 after the last product G of the group of products G has moved from the conveyance surface of the first aligning conveyor 221 onto the conveyance surface of the second aligning conveyor 222.

As shown in FIG. 4D to FIG. 4F, while the second aligning conveyor 222 is conveying a preceding group of products G, or even when a group of products G on the third aligning conveyor 223 is not yet standing up, the product G at the front of the subsequent group of products moves closer to the second aligning conveyor 222.

However, because the upstream end 222*a* of the second aligning conveyor 222 has been lowered, the product at the front of the subsequent group of products does not come into contact with the second aligning conveyor 222 and is not pulled onto the second aligning conveyor 222, and the line of accumulation of the group of products is also inhibited from becoming disarranged.

Figure 4G:
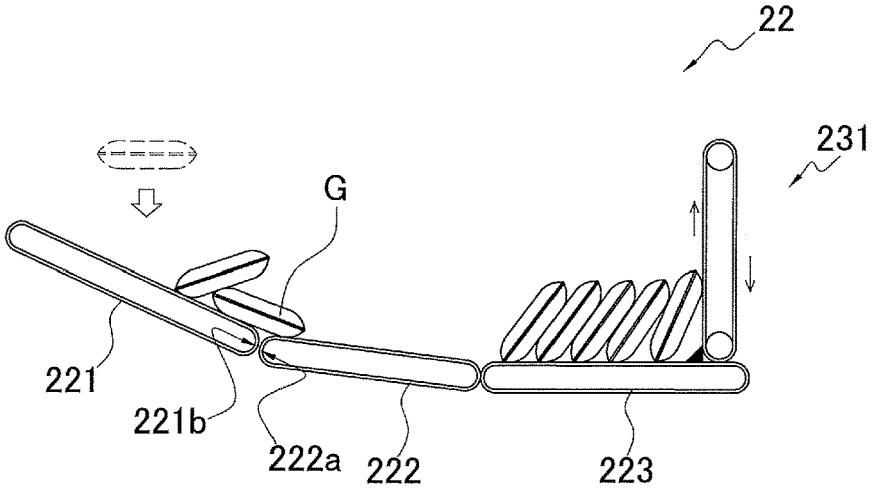
FIG. 4G is a front view of the product aligning unit when the aligned group of products has been switched to a standing state on a third aligning conveyor.

FIG. 4G is a front view of the product aligning unit 22 when the aligned group of products G has been switched to a standing state on the third aligning conveyor 223. In FIG. 4G, a stand-up conveyor 231 whose conveyance surface moves in the vertical direction is disposed on the conveyance direction terminal end portion of the third aligning conveyor 223. It will be noted that in FIG. 4A to FIG. 4F illustration of the stand-up conveyor 231 is omitted for convenience of description.

After the group of products G has moved from the second aligning conveyor 222 onto the third aligning conveyor 223, the product G at the front stands up because of the conveyance surface of the stand-up conveyor 231 that moves in the vertical direction, and then the subsequent products G also stand up.

When the group of products G is in the standing state at the third aligning conveyor 223, products G are not present on the conveyance surface of the second aligning conveyor 222, and products G can be received from the first aligning conveyor 221. Moreover, the timing is such that on the first aligning conveyor 221 the product at the front of the next group of products G has moved closer to and is about to drop onto the second aligning conveyor 222. For that reason, the upstream end 222*a* of the second aligning conveyor 222 is raised so that the second aligning conveyor 222 switches to the first state and can support the product at the front of the group of products G The timing of this up/down operation of the second aligning conveyor 222 will be described in the section titled "(5) Control" in the latter part of this specification.

It will be noted that in the present embodiment, as shown in FIG. 4A, FIG. 4B, FIG. 4C, and FIG. 4G, in the first state the conveyance surfaces of the first aligning conveyor 221 and the second aligning conveyor 222 are both inclined. Additionally, as shown in FIG. 4D, FIG. 4E, and FIG. 4F, in the second state just the upstream end 222*a* of the second aligning conveyor 222 is lowered so that the conveyance surface of the second aligning conveyor 222 in the second state is substantially horizontal.

Furthermore, the controller 40 can decide whether or not to execute the switching to the second state depending on the size of the products G (e.g., the bag size) or can decide whether or not to execute the switching to the second state depending on the required production capacity.

(3-2-3) Third Aligning Conveyor 223

The third aligning conveyor 223 conveys, in front of the openings of the cardboard boxes B standing by, the group of products G aligned by the first aligning conveyor 221 and the second aligning conveyor 222. The third aligning conveyor 223 doubles as an element of the product inserting unit 23 described below.

(3-3) Product Inserting Unit 23

The product inserting unit 23 sandwiches the front and rear of the group of products G aligned in a line by the third aligning conveyor 223 and inserts the whole group of products G into the cardboard boxes B. As shown in FIG. 2B, the product inserting unit 23 has the stand-up conveyor 231, a push-toward plate 233, and an insertion plate 235 in order to sandwich the aligned group of products G.

(3-3-1) Stand-up Conveyor 231

The stand-up conveyor 231 is provided over the downstream end of the third aligning conveyor 223 and blocks the advance of the products G forming a line and being conveyed thereto. The stand-up conveyor 231 is disposed in such a way that its conveyance surface is always orthogonal to the conveyance direction of the products G.

Figure 5A:
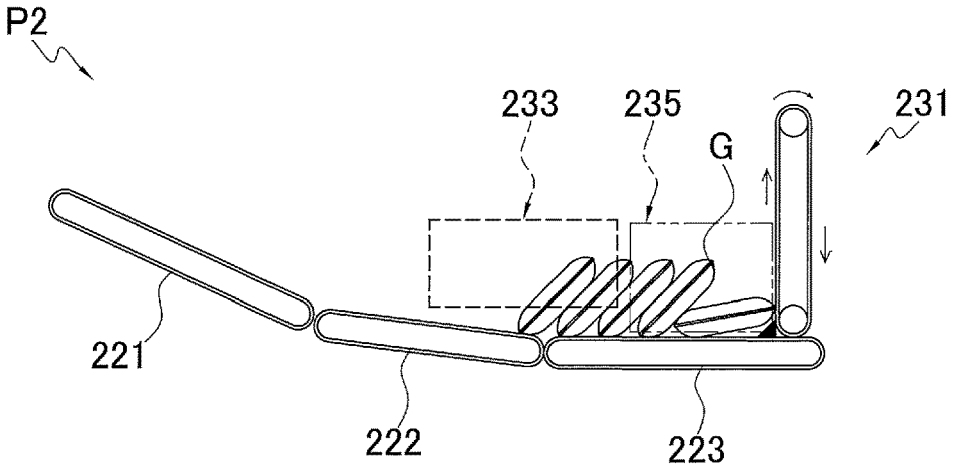
FIG. 5A is a front view of the region around the third aligning conveyor just before the aligned group of products is made to stand up.
Figure 5B:
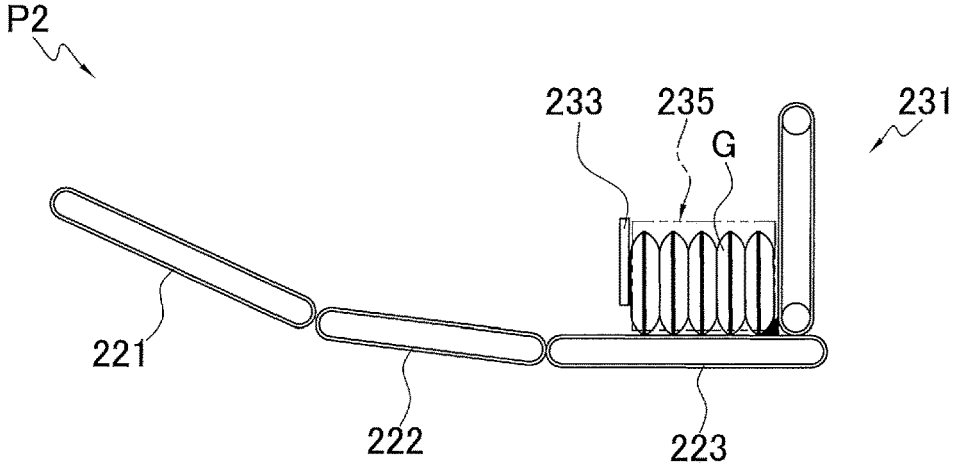
FIG. 5B is a front view of the region around the third aligning conveyor in a state in which the aligned group of products of FIG. 5A has been made to stand up.

FIG. 5A is a front view of the region around the third aligning conveyor 223 just before the aligned group of products G is made to stand up. Furthermore, FIG. 5B is a front view of the region around the third aligning conveyor 223 in a state in which the aligned group of products G of FIG. 5A has been made to stand up. In FIG. 5A and FIG. 5B, the conveyance surface of the stand-up conveyor 231 moves vertically upward a little before the products G come into contact with the conveyance surface of the stand-up conveyor 231. Then, when the leading end of the product G at the front comes into contact with the conveyance surface of the stand-up conveyor 231, an upward force acts on the leading end of the product G, and the horizontal movement of the product G by the third aligning conveyor 223 also continues, so the product G at the front can reliably stand up.

(3-3-2) Push-Toward Plate 233

The push-toward plate 233 pushes the product at the rear of the N-number of products G aligned in a line to thereby sandwich the products G between itself and the stand-up conveyor 231 and cause the products G to stand up.

The push-toward plate 233 is provided on the upstream end side of the third aligning conveyor 223, but while the line of products G is moving from the second aligning conveyor 222 to the third aligning conveyor 223, the push-toward plate 233 is accommodated on the side of the third aligning conveyor 223 so that its flat surface portion is parallel to the conveyance direction of the products G. Furthermore, when the product G at the rear of the line has completely transferred from the second aligning conveyor 222 to the third aligning conveyor 223, the push-toward plate 233 swings so that its flat surface portion becomes orthogonal to the conveyance direction of the products G. Moreover, the push-toward plate 233 pushes the product G at the rear of the line to thereby push the entire line toward the stand-up conveyor 231.

At this time, the conveyance surface of the stand-up conveyor 231 is moving vertically upward, so the product G at the front of the line stands up along the conveyance surface of the stand-up conveyor 231, and the next product G stands up along the product G at the front that has been made to stand up. The subsequent products G also successively stand up because of the same operation, so the N-number of products G become aligned in a standing state.

Furthermore, the product inserting unit 23 collectively pushes, via the insertion plate 235, the N-number of products G in the standing state into the cardboard boxes B. The insertion plate 235 is positioned on the opposite side of the position of the cardboard boxes B across the third aligning conveyor 223. When viewed from the second aligning conveyor 222 side, the open surfaces of the cardboard boxes B are positioned on the right side of the third aligning conveyor 223 and the insertion plate 235 is positioned on the left side of the third aligning conveyor 223.

(3-3-3) Insertion Plate 235

The insertion plate 235 stands by with its flat surface portion opposing the openings of the cardboard boxes B. After the N-number of products G have been switched to the standing state, the insertion plate 235 pushes the N-number of products G toward the open surfaces of the cardboard boxes B and in one tell swoop inserts the N-number of products G through the openings to the bottoms of the cardboard boxes B. The insertion plate 235 crosses between the stand-up conveyor 231 and the push-toward plate 233 and advances to the open surfaces of the cardboard boxes B.

(4) Detailed Configuration of Packing Process P3

The packing process P3 has the product receiving unit 31 that receives the products G into the cardboard boxes B, the second posture changing unit 32 that changes the posture of the cardboard boxes so that the openings of the cardboard boxes face up, and the case sealing unit 33 that conveys the cardboard boxes B that have finished being packed with the products G and at the same time closes the openings of the cardboard boxes B.

(4-1) Product Receiving Unit 31

The product receiving unit 31 maintains the cardboard boxes B in the first posture and has the cardboard boxes B stand by with the openings of the cardboard boxes B opposing the insertion plate 235 of the product inserting unit 23. The N-number of products G that have been switched to the standing state in the product inserting unit 23 are pushed out by the insertion plate 235 toward the open surfaces in the cardboard boxes B, so the product receiving unit 31 stands by in that position until the N-number of products G are completely inserted through the openings to the bottoms of the cardboard boxes B, When a first layer of the N-number of products G is inserted into a cardboard box 13, the product receiving unit 31 descends a predetermined distance. Then, in order to receive a second layer of the N-number of products G, the product receiving unit 31 has the cardboard box B stand by in such a way that the portion of the opening of the cardboard box B that leads to the space above the first layer opposes the insertion plate 235.

The product receiving unit 31 repeats the above-described operation so that an i-th layer of the N-number of products G is inserted into the cardboard box B, and the receiving of the products into the cardboard box B is finished.

(4-2) Second Posture Changing Unit 32

As shown in FIG. 2B, the second posture changing unit 32 has a posture changing mechanism 321 that changes the posture of the cardboard boxes B packed with the products G to a posture in which the openings face up.

The posture changing mechanism 321 rotates the cardboard boxes B so that the open surfaces that had been vertical until then become horizontal, namely, so that the open surfaces face up. The posture changing mechanism 321 uses an L-shaped member with suckers that simultaneously suck the side surface and the bottom surface of the cardboard boxes B to hold the cardboard boxes B, and when the L-shaped member rotates by 90°, the cardboard boxes B rotate.

(4-3) Case Sealing Unit 33

As shown in FIG. 2B, the case sealing unit 33 has a discharge conveyor 330 that conveys the cardboard boxes B, a flap closing mechanism 340 (see FIG. 6A) that closes the flaps around the openings of the cardboard boxes B, a side surface pushing mechanism 355 (see FIG. 7D) that pushes the side surfaces of the cardboard boxes, and a tape applicator 380 that seals the openings closed by the flaps.

(4-3-1) Discharge Conveyor 330

When the cardboard boxes B have been rotated by 90° with the posture changing mechanism 321, the cardboard boxes B are placed on the discharge conveyor 330 in a state in which the openings face up. The discharge conveyor 330 conveys the cardboard boxes B to the discharge position.

(4-3-2) Flap Closing Mechanism 340

Figure 6A:
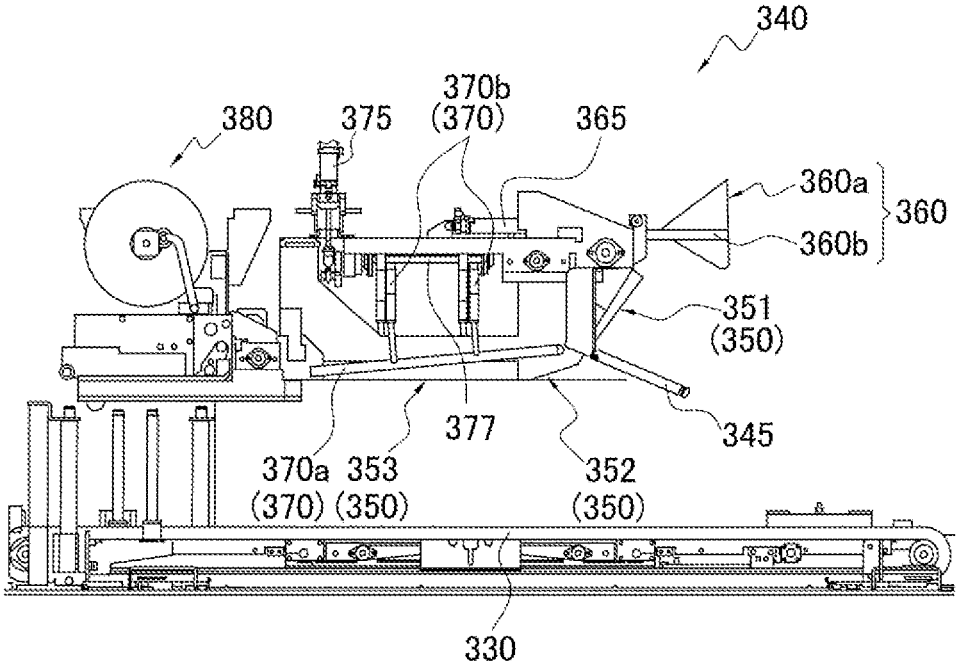
FIG. 6A is a front view of the region around a flap closing mechanism when a cardboard box has not been conveyed thereto.

FIG. 6A is a front view of the region around the flap closing mechanism 340 when a cardboard box B has not been conveyed thereto. Furthermore, FIG. 6B is a front view of the region around the flap closing mechanism 340 when a cardboard box B has been conveyed thereto.

Figure 6B:
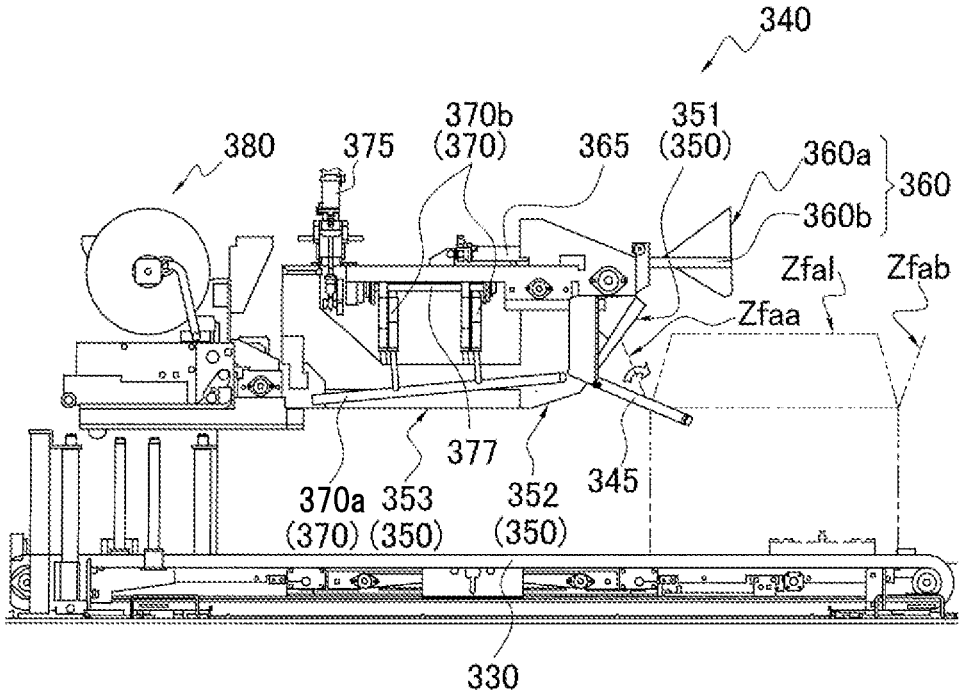
FIG. 6B is a front view of the region around the flap closing mechanism when a cardboard box has been conveyed thereto.
Figure 6C:
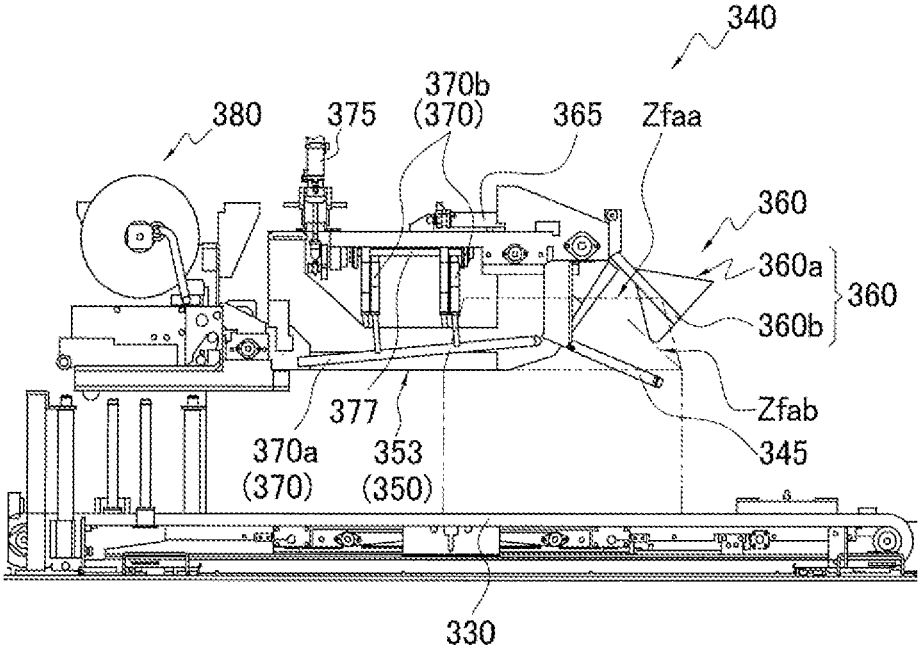
FIG. 6C is a front view of the region around the flap closing mechanism as a rear flap is in the middle of being folded.
Figure 6D:
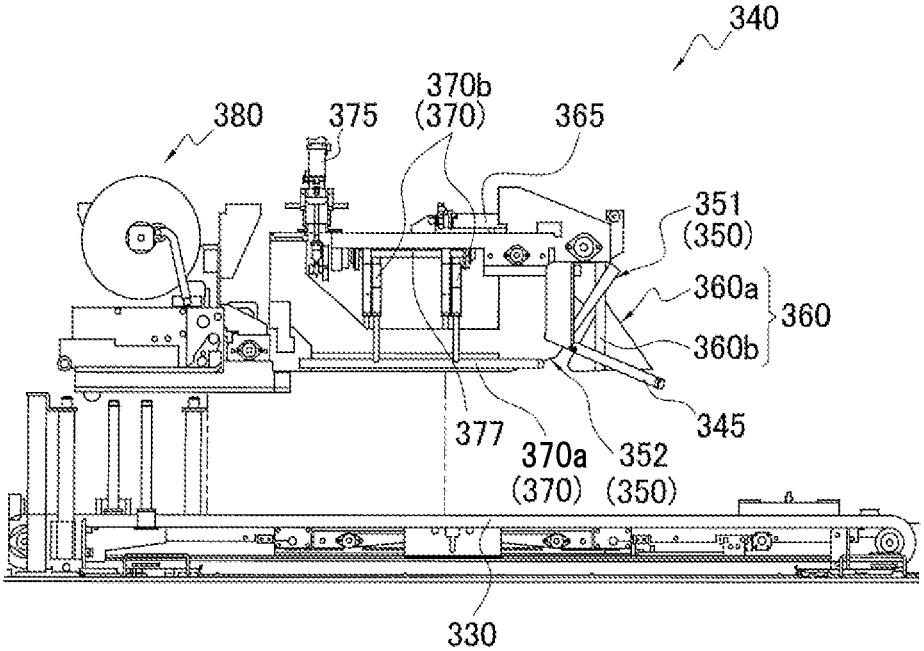
FIG. 6D is a front view of the region around the flap closing mechanism when folding bars have descended to a lowest point.

Furthermore, FIG. 6C is a front view of the region around the flap closing mechanism 340 as a rear flap Zfab is in the middle of being folded. Moreover, FIG. 6D is a front view of the region around the flap closing mechanism 340 when folding bars 370*a* have descended to a lowest point.

In FIG. 6A to FIG. 6C, the flap closing mechanism 340 has a front flap folding member 350, a rear flap folding member 360, and left/right flap folding members 370. The cardboard box B is placed on the discharge conveyor 330 in such a way that its longitudinal direction is parallel to the conveyance direction, and, first, the front flap folding member 350 closes a front flap Zfaa positioned on the front edge of the opening as viewed from the conveyance direction. Next, the rear flap folding member 360 closes a rear flap Zfab positioned on the rear edge of the opening as viewed from the conveyance direction. Next, the left/right flap folding members 370 close a left flap Zfal and a right flap Zfar positioned on the left edge and the right edge of the opening as viewed from the conveyance direction.

It will be noted that before the flap closing mechanism 340 folds the front flap Zfaa, the front edges of the left flap Zfal and the right flap Zfar come into contact with left/right flap raising members 345 so that the left flap Zfal and the right flap Zfar that are open outward become tilted inward.

(4-3-2-1) Left/Right Flap Raising Members 345

The left/right flap raising members 345 are a fixed pair of extension members and have a configuration where the distance that separates them increases heading outward and downward toward their distal ends. The left/right flap raising members 345 wait to receive at their two distal end portions the left flap Zfal and the right flap Zfar of the cardboard box B conveyed thereto, and after the front ends of the left flap Zfal and the right flap Zfar come into contact with the distal end portions, the front ends proceed along the left/right flap raising members 345, so the left flap Zfal and the right flap Zfar become scooped up and tilt inward closer to each other.

(4-3-2-2) Front Flap Folding Member 350

In FIG. 6A, the front flap folding member 350 has a first inclined surface 351, a second inclined surface 352, and a horizontal surface 353.

The first inclined surface 351 is a surface inclined about 50° upward with respect to a horizontal plane. The second inclined surface 352 is a surface inclined about 15° upward with respect to a horizontal plane. The lower end of the first inclined surface 351 is connected to the upper end of the second inclined surface 352, and the lower end of the second inclined surface 352 is connected to one end of the horizontal surface 353.

In FIG. 6B, the front edge of the front flap Zfaa of the cardboard box B comes into contact with the first inclined surface 351 of the front flap folding member 350, and the front edge of the front flap Zfaa is knocked down backward (the direction of the white arrow in FIG. 6B).

When the cardboard box B is conveyed further, the upper surface of the front flap Zfaa that has been knocked down is knocked down further by the second inclined surface 352. Thereafter, when the cardboard box B is conveyed further, the upper surface of the front flap Zfaa is knocked down until it becomes substantially horizontal by the horizontal surface 353, and the folding of the front flap Zfaa finishes.

(4-3-2-3) Side Surface Pushing Mechanism 355

Figure 7A:
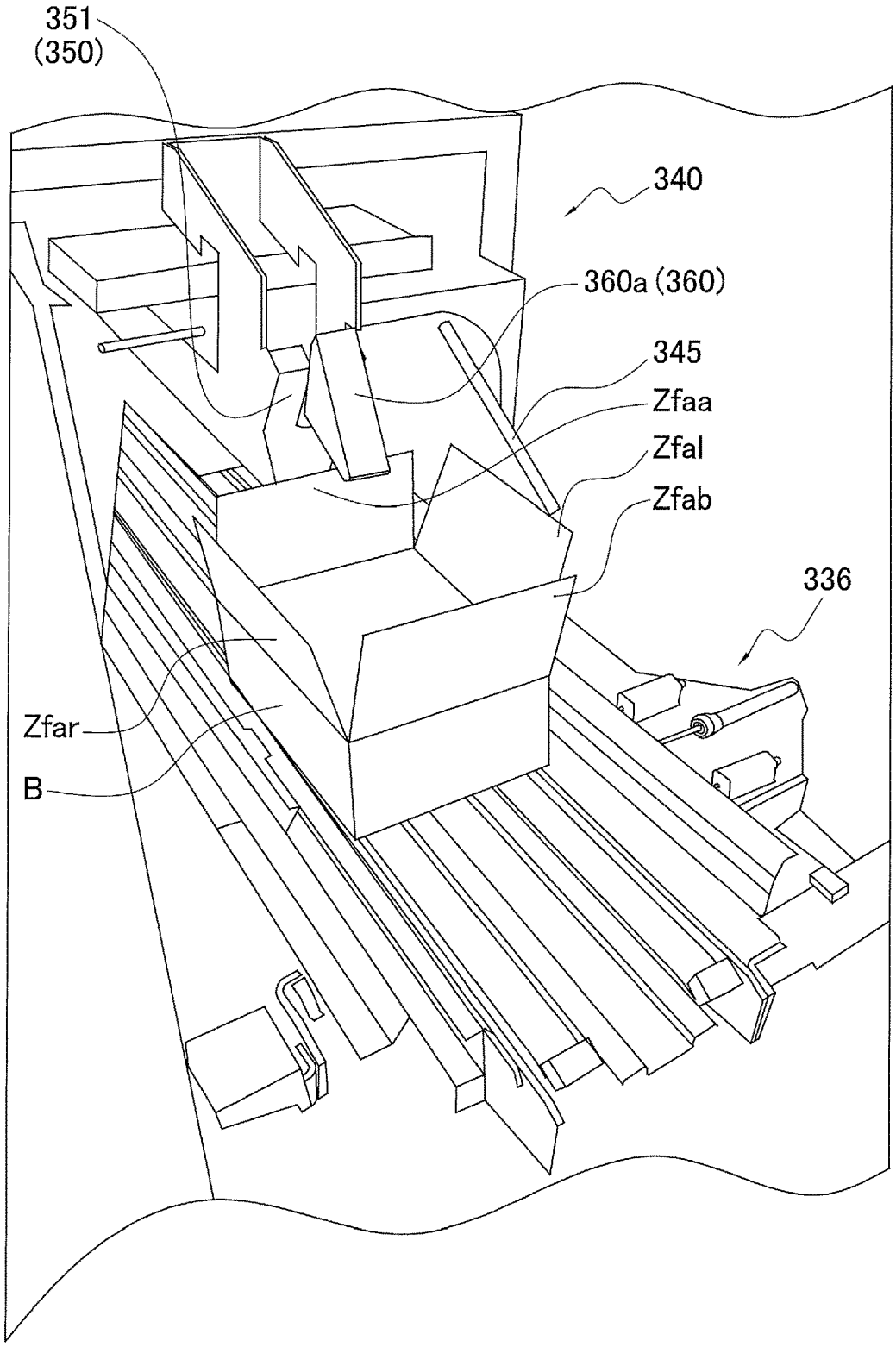
FIG. 7A is a perspective view of the region around the flap closing mechanism just before a front flap of the cardboard box comes into contact with a front flap folding member.
Figure 7B:
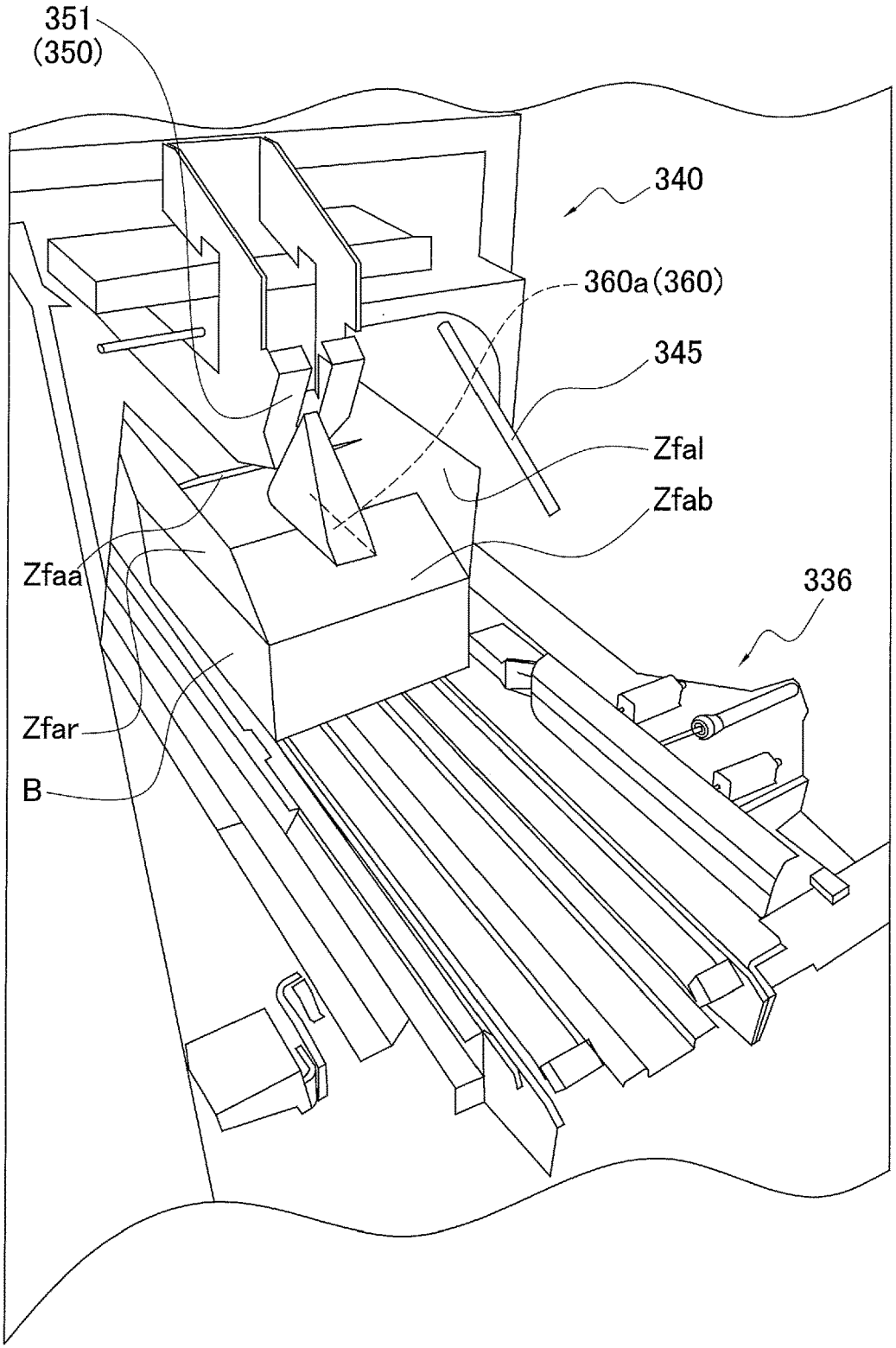
FIG. 7B is a perspective view of the region around the flap closing mechanism when the front flap of the cardboard box is being folded by the front flap folding member.

FIG. 7A shows the region around the flap closing mechanism 340 just before the front flap Zfaa of the cardboard box B comes into contact with the front flap folding member 350. FIG. 7B shows the region around the flap closing mechanism 340 when the front flap Zfaa of the cardboard box B is being folded by the front flap folding member 350.

When, in FIG. 7A and FIG. 7B, the front end of the front flap Zfaa of the cardboard box B comes into contact with the first inclined surface 351 of the front flap folding member 350, there is the concern that the front of the cardboard box B will be lifted up by the reaction thereto.

Furthermore, when the front end of the front flap Zfaa of the cardboard box B comes into contact with the first inclined surface 351 of the front flap folding member 350, the conveyance of the cardboard box B becomes braked, so there is also the concern that the back of the cardboard box B will be lifted up.

Therefore, in the present embodiment, in order to prevent uplift of the cardboard box B, a side surface pushing mechanism that can push the side surface of the cardboard box B that is on the invisible side in FIG. 7A and FIG. 7B is provided.

Figure 7C:
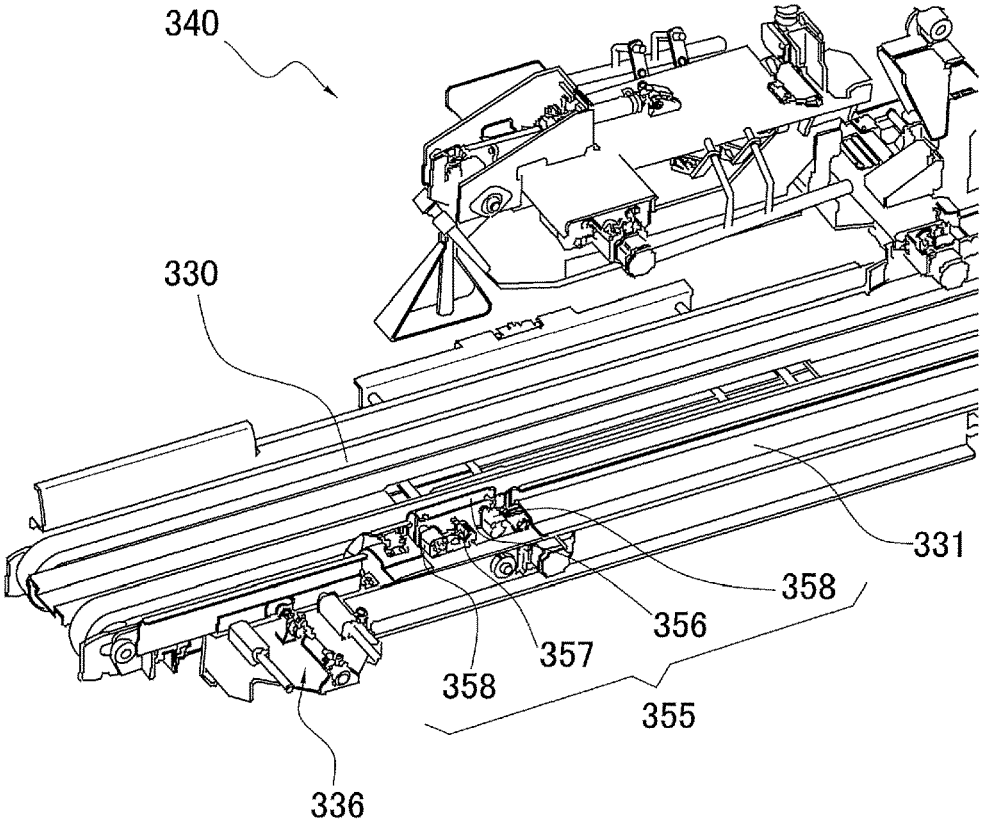
FIG. 7C is a perspective view of the region around a side surface pushing mechanism.
Figure 7D:
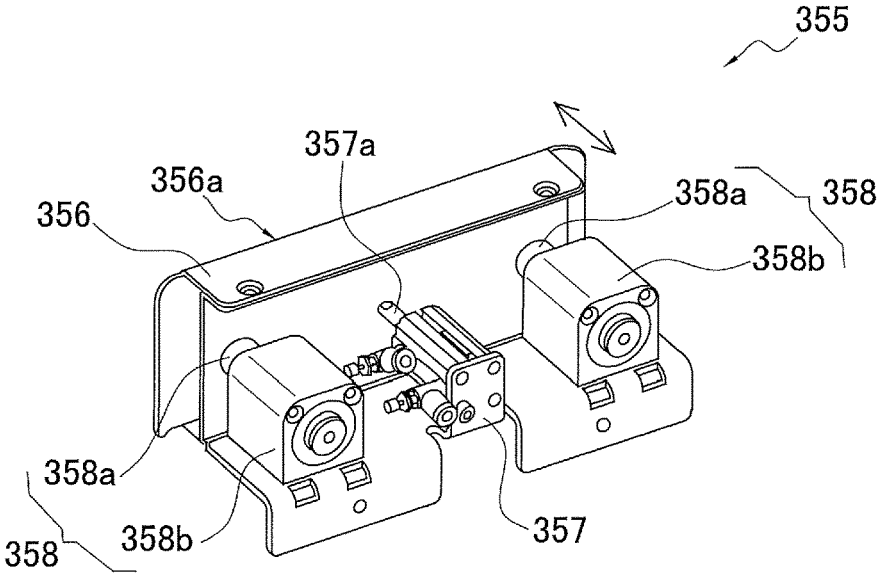
FIG. 7D is a perspective view of the side surface pushing mechanism.

FIG. 7C is a perspective view of the region around the side surface pushing mechanism 355. Furthermore, FIG. 7D is a perspective view of the side surface pushing mechanism.

in FIG. 7C and FIG. 7D, a guide plate 331 that guides, along the discharge conveyor 330, the side surface of the lower portion of the cardboard box B that flows on the discharge conveyor 330 is provided on the side of the discharge conveyor 330, and the side surface pushing mechanism 355 is provided upstream of the guide plate 331 in the conveyance direction.

The side surface pushing mechanism 355 includes a side surface pushing member 356, a side surface pushing air cylinder 357, and support shaft guides 358. The side surface pushing member 356 has a friction surface 356*a*. The friction surface 356*a* is normally positioned in the same plane as the guide plate 331.

The side surface pushing air cylinder 357 has a piston 357*a* that is reciprocally moved by air pressure. The piston 357*a* is coupled to the opposite side of the friction surface 356*a* of the side surface pushing member 356 so that it can push out the friction surface 356*a* of the side surface pushing member 356 onto the conveyance surface of the discharge conveyor 330.

The support shaft guides 358 each have a support shaft 358*a* and a bearing 358*b*. The support shafts 358*a* support the side surface pushing member 356 from the opposite side of the friction surface 356*a*. The bearings 358*b* guide the support shafts 358*a* along the moving direction of the piston 357*a* of the side surface pushing air cylinder 357. In the present embodiment, a total of two support shaft guides 358 are disposed one each on the left and right sides of the side surface pushing air cylinder 357.

It is difficult to stabilize the posture of the side surface pushing member 356 with just the piston 357*a* of the side surface pushing air cylinder 357, so by having the support shafts 358*a* of the support shaft guides 358 support the side surface pushing member 356 from both sides of the piston 357*a*, the side surface pushing member 356 can reciprocally move in a stable posture.

Furthermore, the side surface pushing mechanism 355 not only has the role of preventing uplift of the cardboard box B but also fulfills the function of preventing the cardboard box B from sliding forward when the rear flap is folded.

In the above configuration, when the cardboard box B passes by the friction surface 356*a* of the side surface pushing member 356, the controller 40 causes the piston 357*a* of the side surface pushing air cylinder 357 to advance forward in the direction of the side surface of the cardboard box B so that a predetermined force acts with respect to the side surface pushing air cylinder 357.

The predetermined force is set to an extent that does not hinder the conveyance of the cardboard box 13 and to an extent that the front or the back of the cardboard box B does not lift up, and about 20 N is preferred.

When the front flap Zfaa of the cardboard box B is folded backward by the first inclined surface 351, the side surface of the cardboard box B is away from the friction surface 356*a* of the side surface pushing member 356, so the controller 40 stops the supply of pressure to the side surface pushing air cylinder 357.

It will be noted that in FIG. 7A to FIG. 7D a posture adjustment pushing mechanism 336 having the same mechanism as the side surface pushing mechanism 355 is disposed on the side of the discharge conveyor 330 and upstream of the side surface pushing mechanism 355.

The posture adjustment pushing mechanism 336 pushes the side surface of the cardboard box B to thereby force the posture of the cardboard box B that has been rotated by 90° with the posture changing mechanism 321 and placed on the discharge conveyor 330 into a posture along the conveyance direction of the discharge conveyor 330.

(4-3-2-4) Rear Flap Folding Member 360

In FIG. 6C, the rear flap folding member 360 folds the rear flap Zfab at the timing when the front flap Zfaa of the cardboard box B moves under the horizontal surface 353 of the front flap folding member 350.

The rear flap folding member 360 is a member that is swung by an air cylinder 365. The rear flap folding member 360 has a hold-down plate 360*a* that is bent in a triangular shape and a transmission rod 360*b* that transmits the displacement of a piston of the air cylinder 365 to the hold-down plate 360*a*.

When the controller 40 has judged that the front flap Zfaa of the cardboard box B has moved under the horizontal surface 353 of the front flap folding member 350, the controller 40 drives the air cylinder 365 to thereby cause the hold-down plate 360*a* to swing in a clockwise direction in the front view of FIG. 6C.

As shown in FIG. 7B, the hold-down plate 360*a* swings while holding down the upper surface of the rear flap Zfab. When the hold-down plate 360*a* has swung 90°, the rear flap Zfab becomes folded substantially horizontally.

(4-3-2-5) Left/Right Flap Folding Members 370

As shown in FIG. 6A, FIG. 6B, and FIG. 6C, the left/right flap folding members 370 each have a folding bar 370*a* and two arms 370*b*. The folding bar 370*a* stands by in a higher position than the horizontal surface 353 of the front flap folding member 350.

One end of each arm 370*b* is coupled to the folding bar 370*a*. Furthermore, the arms 370*b* extend in such a way as to intersect the longitudinal direction of the folding bar 370*a* and to a higher position than the folding bar 370*a*. The other ends of the arms 370*b* are connected to a crankshaft 377 that is operated by a folding air cylinder 375.

In reality, the left/right flap folding members 370 are disposed on the near side and the far side in the front views of FIG. 6A, FIG. 6B, and FIG. 6C and stand by with the leading ends of the folding bars 370*a* pointing upward and more outward than the trailing ends. That is, one folding bar 370*a* corresponds to each of the left flap Zfal and the right flap Zfar.

Figure 8:
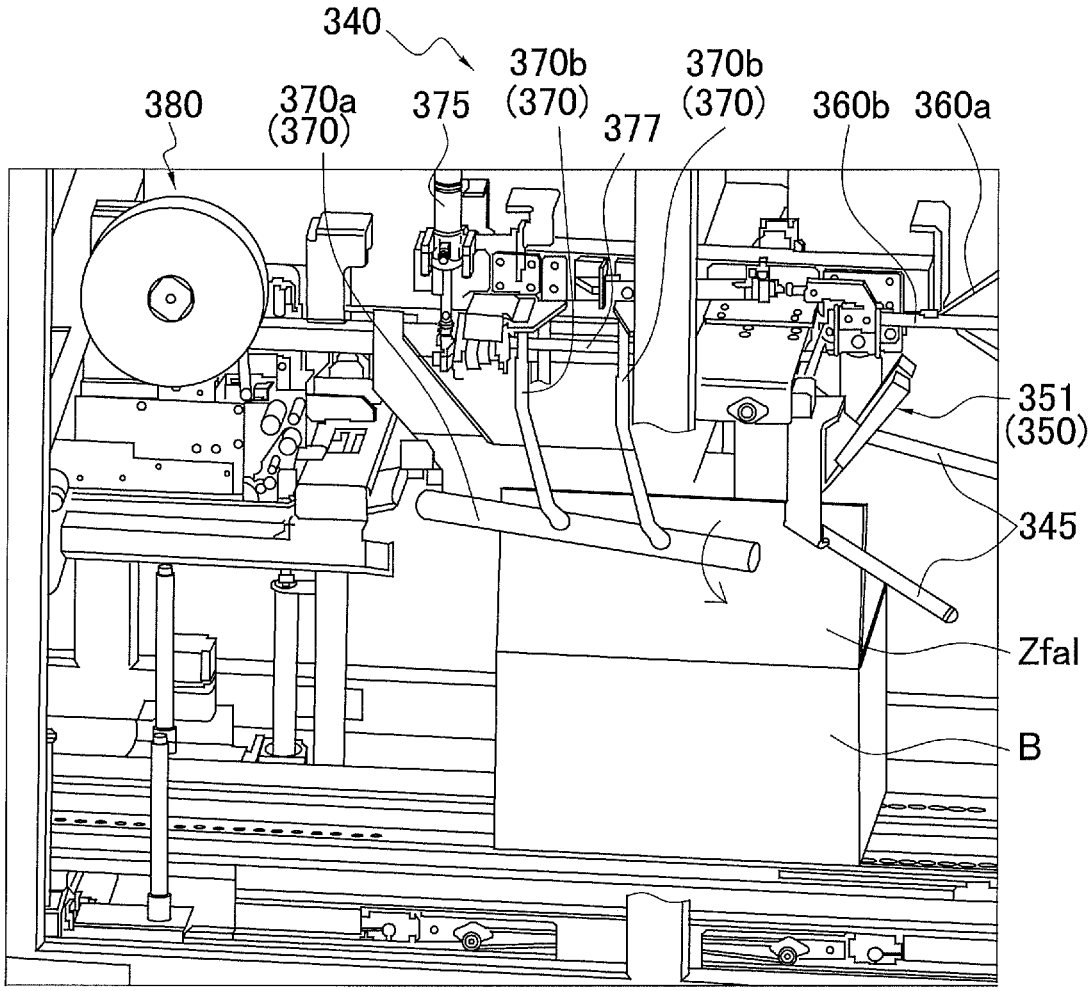
FIG. 8 is a front view of the region around the flap closing mechanism when a left flap of the cardboard box is contacting a folding bar.

Furthermore, FIG. 8 is a front view of the region around the flap closing mechanism 340 when the left flap Zfal of the cardboard box B is contacting the folding bar 370*a*. In FIG. 8, the longitudinal direction of the folding bar 370*a* is inclined with respect to the conveyance direction of the cardboard box B, so the front-side front edges of the left flap Zfal and the right flap Zfar come into contact with the folding bars 370*a* before any other part of the left flap Zfal and the right flap Zfar. It will be noted that the angle of inclination of the longitudinal direction of the folding bars 370*a* with respect to the conveyance direction is within the range of 3° to 60°, but preferably is 30°.

Around substantially the same time as when the front edges of the left flap Zfal and the right flap Zfar of the cardboard box B come into contact with the left/right flap folding members 370, the controller 40 operates the folding air cylinder 375 to thereby cause the folding bars 370*a* to descend while revolving. The folding bars 370*a* are inclined with respect to the conveyance direction also when they descend while revolving.

In FIG. 6D, when the folding bars 370*a* descend to a lowest point, the folding bars 370*a* become substantially horizontal as viewed in the front view of FIG. 6D and so can reliably fold the left flap Zfal and the right flap Zfar.

Figure 9:
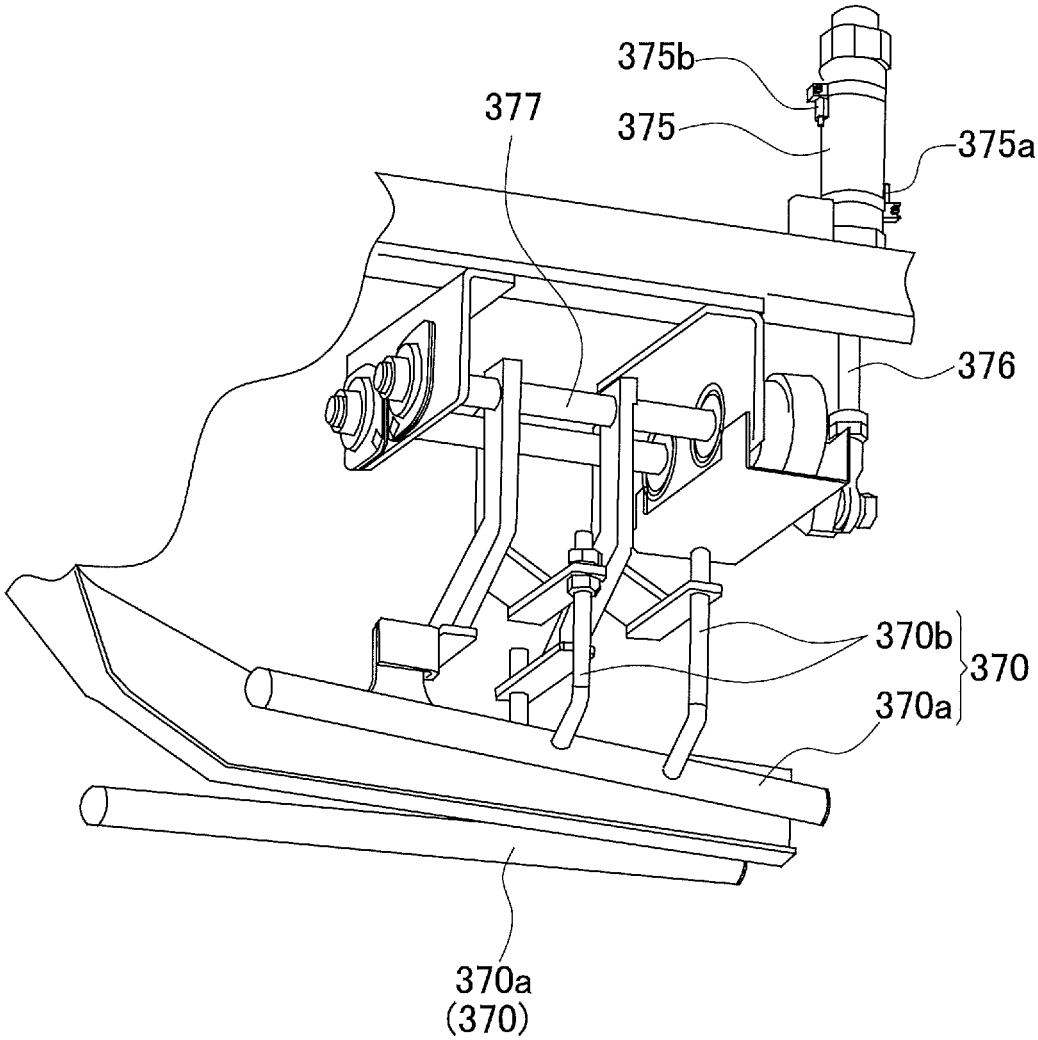
FIG. 9 is a perspective view of left/right flap folding members when the folding bars have descended to the lowest point.

FIG. 9 is a perspective view of the left/right flap folding members 370 when the folding bars 370*a* have descended to the lowest point, and FIG. 9 shows the left/right flap folding members 370 viewed from the opposite direction of the front view of FIG. 8. In FIG. 9, a leading end of a piston 376 of the folding air cylinder 375 is coupled to end portions of the crankshafts 377.

The folding bars 370*a* are coupled to the crankshafts 377 via the arms 370*b*, so when the piston 376 reciprocally moves through a total stroke, the crankshafts 377 turn and the folding bars 370*a* revolvingly operate.

A first sensor 375*a* and a second sensor 375*b* that detect the position of the piston 376 are attached to the folding air cylinder 375. The first sensor 375*a* is attached to the end portion of the folding air cylinder 375 on the piston 376 forward side, and the second sensor 375*b* is attached to the end portion of the folding air cylinder 375 on the piston 376 return side.

The first sensor 375*a* and the second sensor 375*b* switch on in response to a magnet attached beforehand to the piston 376 and output a Lo signal to the controller 40, and the first sensor 375*a* and the second sensor 375*b* switch off when they no longer respond to the magnet and output a Hi signal to the controller 40.

Consequently, the controller 40 can judge that the piston 376 has reached the terminal end of the forward stroke when the first sensor 375*a* switches on, and the controller 40 can judge that the piston 376 has reached the terminal end of the return stroke when the second sensor 375*b* switches on. FIG. 9 shows a state in which the piston 376 has reached the terminal end of the forward stroke, and the folding bars 370*a* have descended to the lowest point and are exactly in the state in FIG. 6D.

According to the left/right flap folding members 370, the folding bars 370*a* can gradually fold the left flap Zfal and the right flap Zfar from the front-side front edges of the left flap Zfal and the right flap Zfar in the conveyance direction to the rear sides, so the left flap Zfal and the right flap Zfar are reliably folded along the "fold lines" provided beforehand at their bases.

(4-3-3) Tape Applicator 380

The openings of the cardboard boxes B are closed as a result of the front flap Zfaa, the rear flap Zfab, the left flap Zfal, and the right flap Zfar being folded and are sealed by the tape applicator 380. The tape applicator 380 is installed near the discharge position on the conveyance path of the cardboard boxes B, and taping is performed before the cardboard boxes B reach the discharge position.

The tape applicator 380 guides, along the conveyance direction, the upper portions of both width direction side surfaces of the cardboard boxes B while applying tape to the cardboard boxes B.

(4-3-3-1) Guide Member 390

Figure 10:
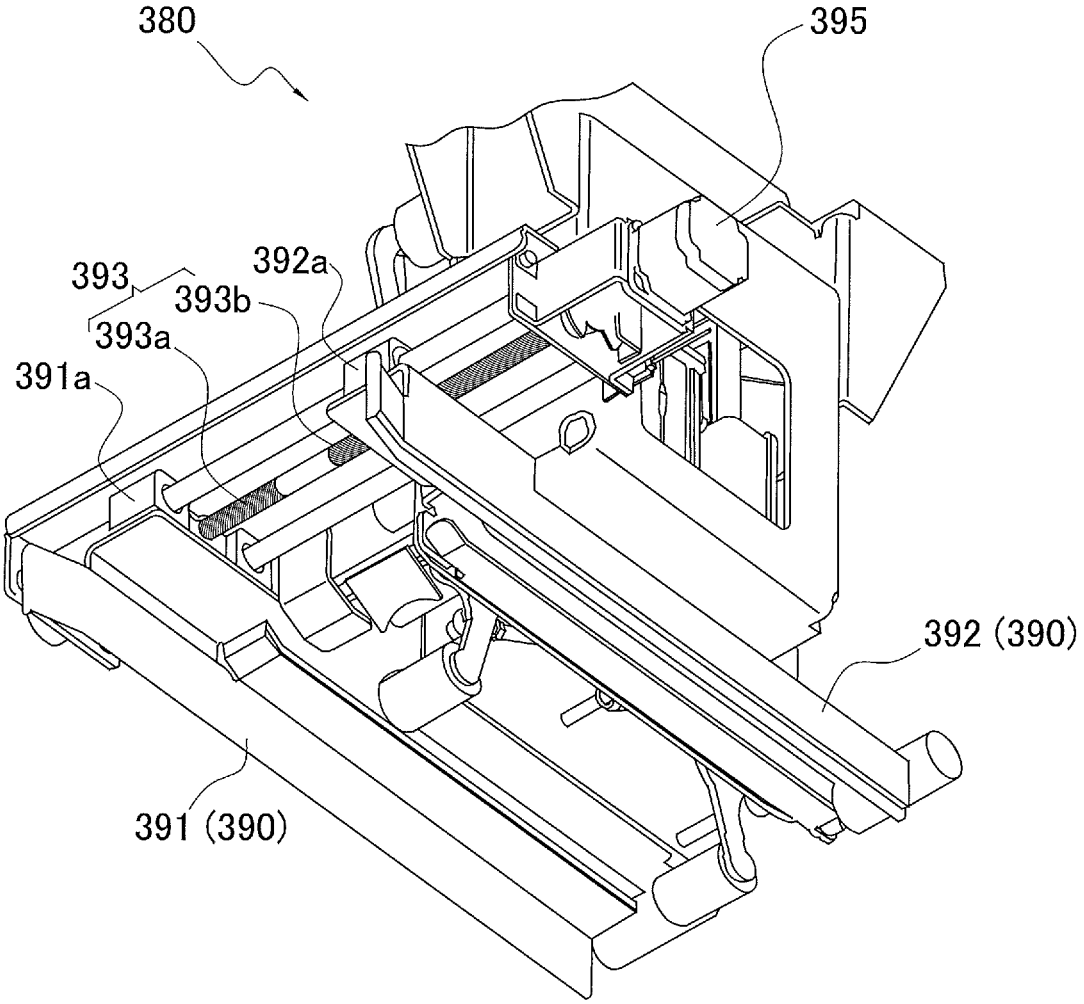
FIG. 10 is a perspective view of a guide member.

FIG. 10 is a perspective view of a guide member 390 and shows the tape applicator 380 of FIG. 8 as viewed from a direction looking up at the tape applicator 380 from below. In FIG. 10, the guide member 390 is located on the bottom portion of the tape applicator and has a pair of guide plates (391, 392) whose intervening distance can be changed.

One of the pair of guide plates will be called a first guide plate 391 and the other guide plate will be called a second guide plate 392. The first guide plate 391 and the second guide plate 392 are symmetrical with respect to a vertical plane parallel to the conveyance direction. End portions of the first guide plate 391 and the second guide plate 392 on the side that receives the cardboard boxes B conveyed thereto are inclined surfaces that widen outward heading closer to the ends, but except for those the first guide plate 391 and the second guide plate 392 are flat surfaces parallel to the conveyance direction of the cardboard boxes B.

(4-3-3-2) Adjustment of Distance in Guide Member 390

The first guide plate 391 is connected to a ball screw 393 via a first block 391*a*. In the same way, the second guide plate 392 is connected to the ball screw 393 via a second block 392*a*. The first block 391*a* and the second block 392*a* are both screwed to the ball screw 393.

A portion 393*a* of the ball screw 393 screwed to the first block 391*a* and a portion 393*b* of the ball screw 393 screwed to the second block 392*a* have opposite thread cut directions. Consequently, when the ball screw 393 rotates in one direction, the first block 391*a* and the second block 392*a* move in parallel in directions toward each other so that the distance between the first guide plate 391 and the second guide plate 392 decreases. When the ball screw 393 rotates in the opposite direction, the first block 391*a* and the second block 392*a* move in parallel in directions away from each other so that the distance between the first guide plate 391 and the second guide plate 392 increases.

One end of the ball screw 393 is connected to a stepping motor 395. In the present embodiment, when the ball screw 393 rotates in the clockwise direction as viewed from the stepping motor 395, the distance between the first guide plate 391 and the second guide plate 392 decreases, and when the ball screw 393 rotates in the counter-clockwise direction, the distance between the first guide plate 391 and the second guide plate 392 increases.

The controller 40 reads the width dimension of the cardboard boxes B from cardboard box size input data when production starts or when products are switched and causes the stepping motor 395 to rotate to thereby automatically adjust the distance between the first guide plate 391 and the second guide plate 392.

(5) Control

Up to now the configurations of each part of the packing system have been described together with their operations, but here control of raising and lowering of the second aligning conveyor 222, control when there is a sensor malfunction in an air cylinder, and control when there is a malfunction of an origin position sensor of the stepping motor, which perform operations that are special among those, will be described.

(5-1) Control of Raising and Lowering of Second Aligning Conveyor 222

Figure 11:
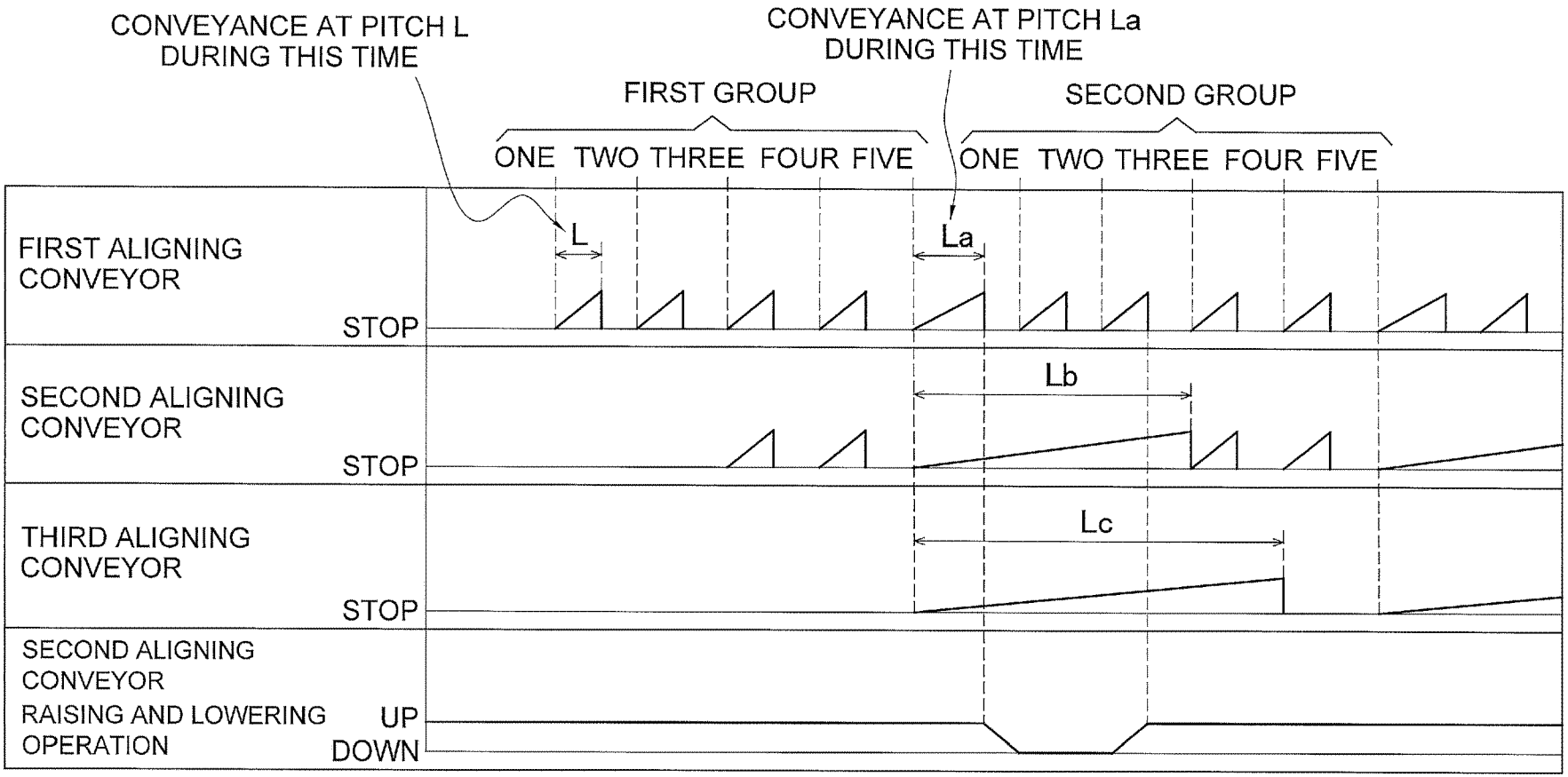
FIG. 11 is a timing chart showing the operations of the first aligning conveyor, the second aligning conveyor, and the third aligning conveyor.

FIG. 11 is a timing chart showing the operations of the first aligning conveyor 221, the second aligning conveyor 222, and the third aligning conveyor 223. Below, the timing when the second aligning conveyor 222 is raised and lowered will be described with reference to FIG. 4A to FIG. 4G and FIG. 11.

First, in FIG. 4A to FIG. 4C and FIG. 11, the first aligning conveyor 221 performs an intermittent conveyance at pitch L each time one to four products G of a first group of products lands on the first aligning conveyor 221.

The second aligning conveyor 222 starts an intermittent operation at the same time as the third intermittent conveyance by the first aligning conveyor 221 when the third product G lands on the first aligning conveyor 221.

This is because, as shown in FIG. 4A, the product G that landed first on the first aligning conveyor 221 is starting to move onto the upstream end 222*a* of the second aligning conveyor 222, so by also causing the second aligning conveyor 222 to intermittently convey at pitch L at the same time, the product G is received onto the second aligning conveyor 222, Consequently, at the time in point when the fourth product G lands on the first aligning conveyor 221 and there are a fourth intermittent conveyance by the first aligning conveyor 221 and a second intermittent conveyance by the second aligning conveyor 222, at least the product G at the front has moved onto the second aligning conveyor 222, and the third and fourth products G are on the first aligning conveyor 221.

Then, after the fifth product G lands on the first aligning conveyor 221, the first aligning conveyor 221 conveys at pitch La, which is greater than pitch L. This is a conveyance amount needed to transfer to the second aligning conveyor 222 the third and fourth products G that have already landed on the first aligning conveyor 221 and the fifth product G that has just landed.

After ending the intermittent conveyance at pitch La, the first aligning conveyor 221 receives a second group of products G and starts the intermittent conveyance at pitch L.

The second aligning conveyor 222 starts an intermittent conveying operation at a long pitch Lb at the same time as when the first aligning conveyor 221 starts the intermittent conveyance at pitch La. The upstream end 222*a* of the second aligning conveyor 222 is lowered in the middle of this intermittent operation at the long pitch Lb and at the same time as when the first aligning conveyor 221 ends the intermittent conveyance at pitch La (see FIG. 4D).

The reason the upstream end 222*a* of the second aligning conveyor 222 is lowered in this way is, the first product G of the second group that has already landed on the first aligning conveyor 221 is moving closer to the upstream end 222*a* of the second aligning conveyor 222, and if the upstream end 222*a* is not lowered the first product G of the second group will be pulled onto the second aligning conveyor 222 that is conveying the first group of products G.

Then, at the point in time when the second product G of the second group lands on the first aligning conveyor 221 and the intermittent conveyance at pitch L finishes, the first group of products G is being transferred from the second aligning conveyor 222 to the third aligning conveyor 223 and the first group of products G is being switched to the standing state by the stand-up conveyor 231 on the third aligning conveyor 223, so there are no products G on the second aligning conveyor 222, and the second aligning conveyor 222 can receive the second group of products G from the first aligning conveyor 221. For that reason, the upstream end 222*a* of the second aligning conveyor 222 is raised and returned to its original position (see FIG. 4G).

It will be noted that the intermittent conveyance at the long pitch Lb by the second aligning conveyor 222 finishes by the time the second product G of the second group lands on the first aligning conveyor 221 and the intermittent conveyance at pitch L finishes and the third product G lands.

The third aligning conveyor 223 starts an intermittent conveying operation at a long pitch Lc at the same time as when the first aligning conveyor 221 starts the intermittent conveyance at pitch La. The third aligning conveyor 223 finishes the intermittent conveyance at the long pitch Lc by the time the third product G of the second group lands on the first aligning conveyor 221 and the intermittent conveyance at pitch L finishes and the fourth product G lands.

During the time period of the intermittent conveyance at the long pitch Lc, the first to fifth products G of the first group finish aligning on the conveyance surface of the third aligning conveyor 223, and their insertion into the cardboard box B finishes.

(5-2) Control When There is a Sensor Malfunction in Air Cylinder 375

The packing system 1 has plural air cylinders as actuators, and sensors for detecting the positions of pistons are attached to each air cylinder. If a position detection sensor on any one air cylinder of the plural air cylinders fails, the entire packing system 1 is stopped and the sensor is replaced.

Consequently, if production is stopped until replacement of the sensor is finished and by chance the sensor is out of stock, the time in which the packing system 1 is stopped becomes prolonged and productivity significantly drops. In order to avoid such a situation, in the present embodiment the necessary operating time of each air cylinder is stored beforehand and even if a sensor fails the operating time is controlled by a timer, so that the operation of the packing system can be continued for a certain period of time.

Control when there is a position detection sensor malfunction will be described below with reference to flowcharts. Here, a case where either of the first sensor 375*a* and the second sensor 375*b* of the folding air cylinder 375 described in the section titled "(4-3-2-5) Left/Right Flap Folding Members 370" has failed will be described.

Figure 12A:
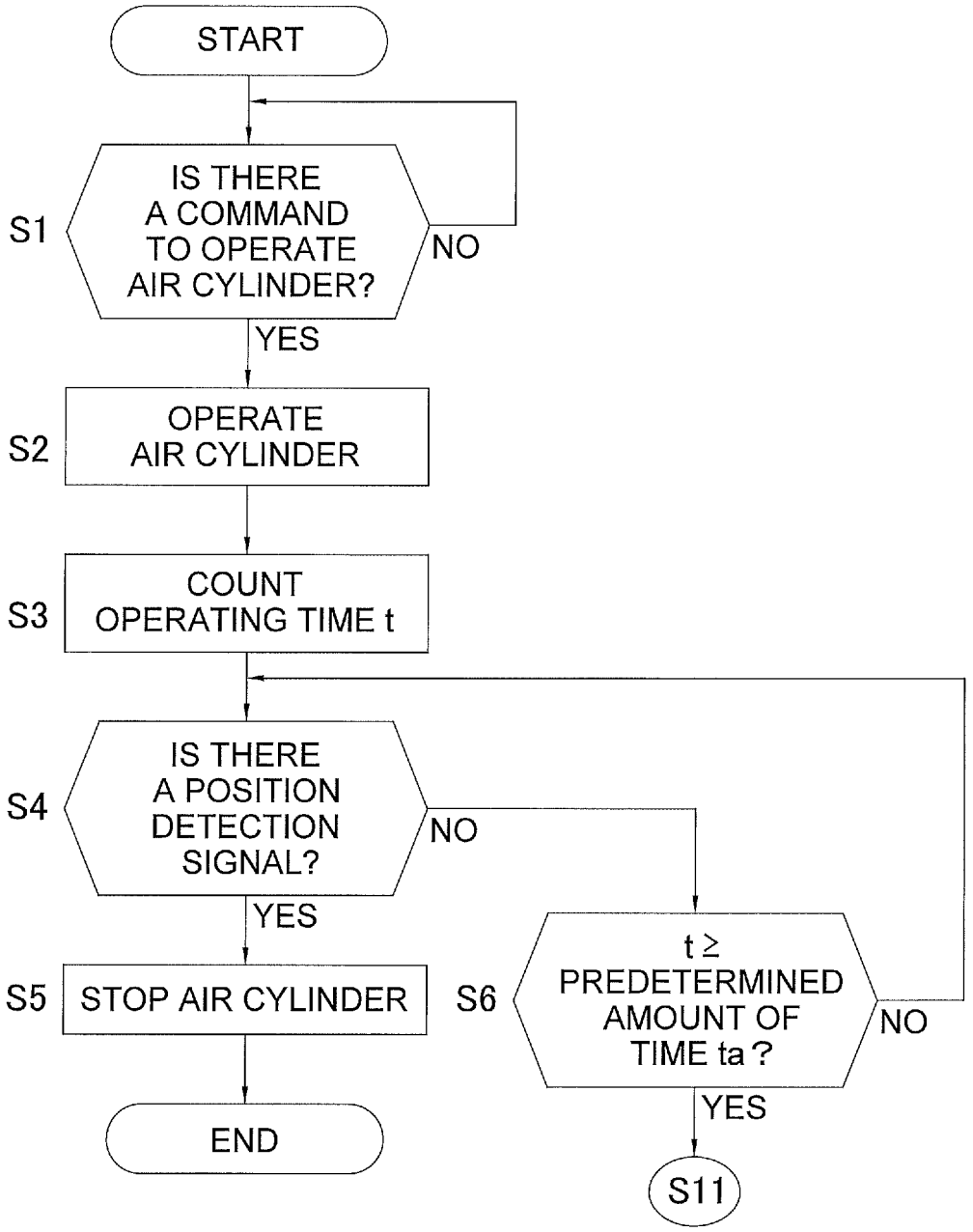
FIG. 12A is a flowchart of control when there is a sensor malfunction (a flow from step S1 to step S6)
Figure 12B:
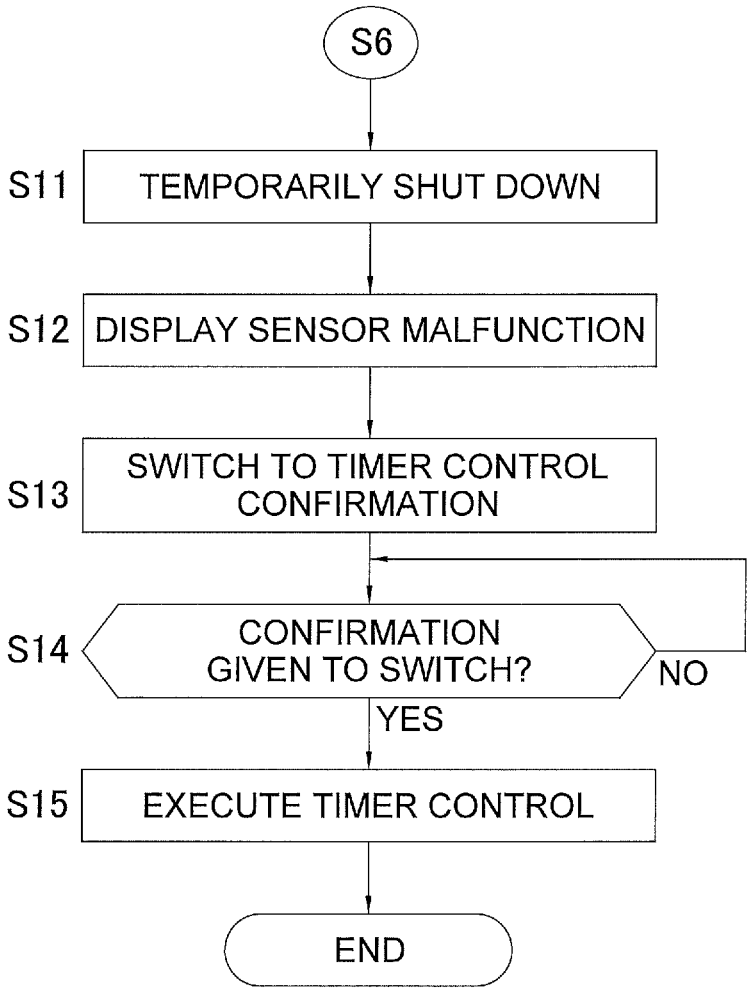
FIG. 12B is flowchart of control where there is a sensor malfunction (a flow from step S11 to step S15)

FIG. 12A and FIG. 12B are control flowcharts when there is a sensor malfunction. FIG. 12A shows a flow from step S1 to step S6, and FIG. 12B shows a flow from step S11 to step S15.

(5-2-1) Description of Flow in FIG. 12A

Step S1

In FIG. 12A, the controller 40 determines whether or not there is a command to operate the folding air cylinder 375 in step S1. When there is an operation command, the controller 40 proceeds to step S2.

Step S2

Next, the controller 40 operates the folding air cylinder 375 in step S2. Then, the controller 40 proceeds to step S3.

Step S3

Next, the controller 40 counts an operating time t of the folding air cylinder 375 in step S3. Then, the controller 40 proceeds to step S4.

Step S4

Next, the controller 40 determines whether or not there is a detection signal from the first sensor 375*a* or the second sensor 375*b* in step S4. As described in the section titled "(4-3-2-5) Left/Right Flap Folding Members 370", when the first sensor 375*a* switches on, the controller 40 can judge that the piston 376 of the air cylinder 375 has reached the terminal end of the forward stroke, and when the second sensor 375*b* switches on, the controller 40 can judge that the piston 376 has reached the terminal end of the return stroke.

Consequently, when there is a detection signal from the first sensor 375*a* or the second sensor 375*b*, the controller 40 proceeds to step S5.

Step S5

The controller 40 stops the operation of the air cylinder in step S5.

Step S6

When there is no detection signal from the first sensor 375*a* or the second sensor 375*b* in the previous step S4, the controller 40 proceeds to step S6 and determines whether or not the operating time t has reached a predetermined amount of time ta.

Here, the predetermined amount of time ta is the necessary operating time, which comprises the design value of the operating time of the folding air cylinder 375 and error added thereto. The predetermined amount of time ta is stored in a memory 401 (see FIG. 13) built into the controller 40. The necessary operating time comprising the design value of the operating time of the folding air cylinder and error added thereto is ta=t1 in the forward stroke and ta=t2 in the return stroke.

Consequently, when t≥t1 in a case where the folding air cylinder 375 operated in the forward stroke, or when t≥t2 in a case where the folding air cylinder 375 operated in the return stroke, the controller 40 proceeds to step S11.

(5-2-2) Description of Flow in FIG. 12B

Step S11

In FIG. 12B, the controller 40 temporarily stops the operation of the packing system 1 in step S11. This is because the controller 40 judged previously in step S6 that there is a sensor malfunction because it did not receive a detection signal from the first sensor 375*a* or the second sensor 375*b* even though the operating time t reached the predetermined amount of time ta.

Step S12

The controller 40 performs a sensor malfunction display to notify the operator of the packing system 1 that there is a malfunction. If the packing system 1 has a display for display, the controller 40 displays the notification on the screen of the display. The controller 40 can also notify the operator using an alarm or an audio message, for example.

Step S13

Next, the controller 40 performs a switch to timer control confirmation. Specifically, the controller 40 asks, via a display 400 for display (see FIG. 13), the operator of the packing system 1 whether or not to perform a switch to timer control.

Step S14

Next, the controller 40 determines whether or not there is a confirmation to switch to timer control. When there is a confirmation to switch to timer control, the controller 40 proceeds to step S15, and when there is not a confirmation to switch to timer control, the controller 40 continues the determination. The controller 40 can, for example, have a configuration where the operator confirms the switch to timer control by touching a confirmation button displayed on the screen of the display 400 for display.

Step S15

In step S15 the controller 40 controls the operation of the forward stroke and the return stroke of the folding air cylinder 375 on the basis of the necessary operating time stored beforehand, without relying on the detection signal from the first sensor 375*a* or the second sensor 375*b*.

According to the above-described control, the operation of the air cylinder can be controlled by a timer, and the operation of the packing system 1 can be continued while ignoring the signals from the position detection sensors.

(5-3) Control When There is a Malfunction of Origin Position Sensor of Stepping Motor Control to operate and stop the actuators such as the folding air cylinder 375 can be performed using the necessary operating time stored beforehand, but using the operating time to control an actuator whose mechanical destructive power is large, such as a motor, is dangerous.

For example, in the case of a stepping motor whose position, for example, is decided by sensor detection, the necessary rotational amount can be output as a result of predetermined pulses being input, and when combined with an origin position sensor, by controlling the number of pulses input after detecting the position detection signal of the origin position sensor, a movable member coupled to the stepping motor can be moved to the intended position.

However, in a case where the origin position sensor has failed in a mechanism driven by the stepping motor, productivity significantly drops because the packing system 1 becomes shut down until the failed origin position sensor is replaced with a normal origin position sensor.

Meanwhile, in the stepping motor-driven mechanism, if its position is set once, there is no need to reset the position until the next product switching, so there are also circumstances where it is alright for the operator to manually set the position.

Therefore, in the present embodiment, control when there is a malfunction of the origin position sensor of the stepping motor as a stop-gap measure will be specifically described with reference to the drawings.

Figure 13:
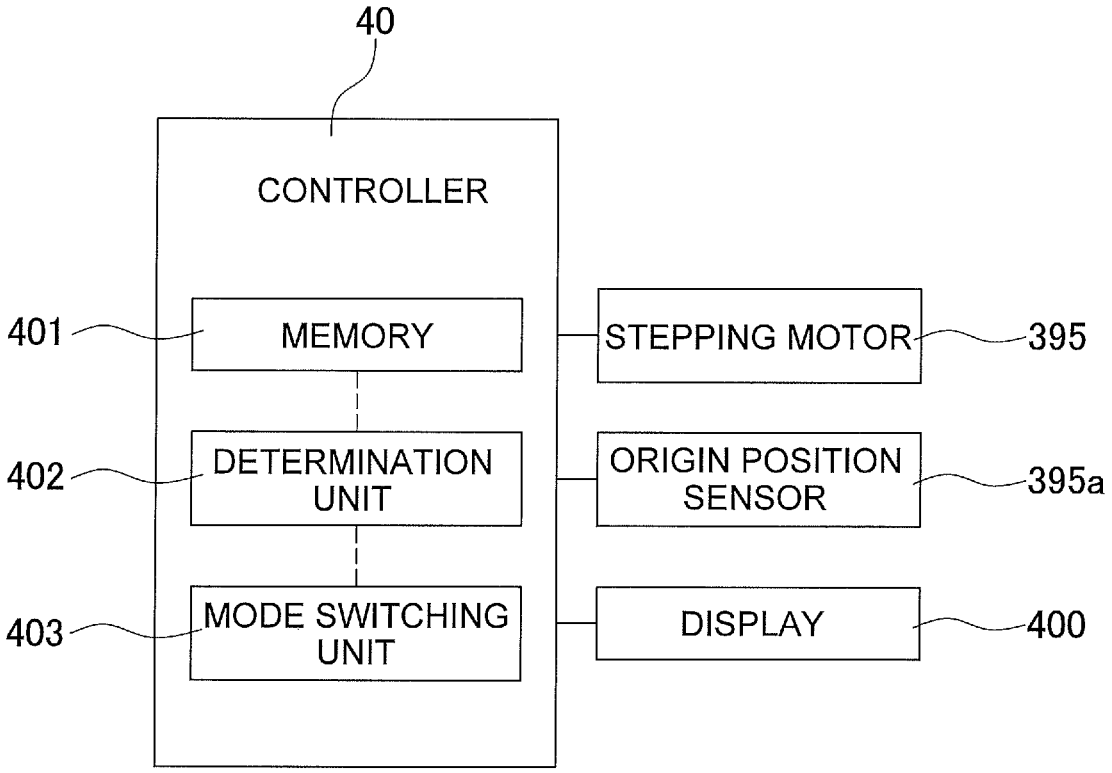
FIG. 13 is a control block diagram of a stepping motor shown in FIG. 10.

FIG. 13 is a control block diagram of an actuator such as the stepping motor 395 shown in FIG. 10. In FIG. 13, various sensors such as an origin position sensor 395*a* of the ball screw 393 driven by the stepping motor 395 are connected to the controller 40.

As mentioned in the section titled "(4-3-3-2) Adjustment of Distance in Guide Member 390" which has already been described, when the ball screw 393 rotates in the clockwise direction as viewed from the stepping motor 395, the distance between the first guide plate 391 and the second guide plate 392 decreases, and when the ball screw 393 rotates in the counter-clockwise direction, the distance between the first guide plate 391 and the second guide plate 392 increases.

In the memory 401 is stored the relationship between the rotational amount (number of input pulses) of the stepping motor 395 from an origin position and the distance between the first guide plate 391 and the second guide plate 392, and the controller 40 reads the width dimension of the cardboard boxes B from cardboard box size input data when production starts or when products are switched and causes the stepping motor 395 to rotate to thereby automatically adjust the distance between the first guide plate 391 and the second guide plate 392.

When a determination unit 402 determines that the origin position sensor 395*a* is malfunctioning, a mode switching unit 403 displays that the origin position sensor 395*a* is malfunctioning on the display 400 serving as a display unit, and preferably displays an indication that "The auto mode for adjusting the distance between the first guide plate 391 and the second guide plate 392 is inexecutable" and performs a display that asks "Would you like to manually adjust the distance between the first guide plate 391 and the second guide plate 392?"

It will be noted that as a specific example of the determination unit 402 determining that the origin position sensor 395*a* is malfunctioning, the determination unit 402 determines that the origin position sensor 395*a* is malfunctioning in a case where the position signal that should be detected is not being output from the origin position sensor 395*a* even though sufficient pulses are being input to the stepping motor 395.

In a case where the operator is able to soon replace the origin position sensor 395*a*, it suffices for the operator to replace the origin position sensor 395*a* with a normal origin position sensor 395*a*, without confirming the switch to the manual mode, and allow the auto mode to adjust the distance between the first guide plate 391 and the second guide plate 392.

On the other hand, in a case where the origin position sensor 395*a* is out of stock and it will take time to order another one, as a stop-gap measure until then the operator selects the manual mode, in which the operator manually performs the adjustment of the distance between the first guide plate 391 and the second guide plate 392, presses the confirmation button displayed on the screen of the display 400, and confirms the switch to the manual mode.

Because of this, even if the origin position sensor 395*a* of the ball screw 393 fails, by switching the adjustment of the distance between the first guide plate 391 and the second guide plate 392 to the manual mode, the operation of the packing system 1 can be continued while ignoring the signal of the origin position sensor 395*a*.

(6) Example Modifications

Here, example modifications that could not be described in the above embodiment and in which just some configurations are changed will be described.

In the above section titled "(4-3-2-3) Side Surface Pushing Mechanism 355" there was described employing a configuration where the friction surface 356*a* of the side surface pushing member 356 pushes the side surface of the cardboard box B so that the friction surface 356*a* and the side surface of the cardboard box B rub against each other.

However, because the function of the side surface pushing mechanism 355 is preventing uplift of the front or back of the cardboard box B, that function can also be realized by another configuration.

6-1

For example, the side surface of the cardboard box B can also be pushed by a rotatable roller instead of the friction surface 356*a*.

If the rotating shaft of the roller is vertically set, the roller rotates as a result of rubbing against the side surface of the cardboard box B, so the side surface of the cardboard box B being conveyed can be inhibited from being scratched.

6-2

Furthermore, by configuring the friction surface 356*a* to move in the conveyance direction of the cardboard box B, the friction surface 356*a* moves together with the cardboard box B while holding down the side surface of the cardboard box B, so the friction surface 356*a* is inhibited from rubbing against the side surface of the cardboard box B and the side surface of the cardboard box B being conveyed can be inhibited from being scratched.

(7) Characteristics of the Embodiment 7-1

In the packing system 1, the cardboard box handling area DHA and the product handling area GHA can be completely separated from each other, so it becomes easy to organize the layout and the layout can be changed in conformity to production realities, which also contributes to inhibiting an increase in the installation area of the packing system 1 overall.

7-2

In the packing system 1, the cardboard box precursors Z that are case forming sheets are arranged and accommodated in such a way that their openings face up when the cardboard box precursors Z are opened, and thus the height of the cardboard box precursors Z stocked in the box precursor accommodating unit 11 is unchanging regardless of the stock quantity, so basically there is no need to limit the quantity of cardboard box precursors Z accommodated, and even when the cardboard box precursors Z are restocked, the cardboard box precursors Z just extend backward a length equal to the thickness dimension of the cardboard box precursors Z multiplied by the restock quantity.

7-3

In the packing system 1, the cardboard boxes B switch to a posture in which they open toward the conveyance direction, so by supplying the products toward the openings of the cardboard boxes B, the products G can be loaded sideways into the cardboard boxes B.

7-4

By giving the packing system 1 a hierarchical line configuration where, for example, the case forming unit 12 is positioned on the second level and the case sealing unit 33 is positioned on the first level, the installation area of the cardboard box handling area DHA can be reduced.

7-5

In the packing system 1, the case forming unit 12, the first posture changing unit 13, the product receiving unit 31, the second posture changing unit 32, and the case sealing unit 33 are supported by the common frame 10, so the packing system 1 is an all-in-one machine, has a small footprint, and also has a good visual appearance.

REFERENCE SIGNS LIST

1 Packing System (Case Forming, Packing, and Sealing Apparatus)

10 Frame
11 Box Precursor Accommodating Unit (Accommodating Unit)
12 Case Forming Unit
13 First Posture Changing Unit
22 Product Aligning Unit
23 Product Inserting Unit
33 Case Sealing Unit
DHA Cardboard Box Handling Area
GHA Product Handling Area
G Products
Z Cardboard Box Precursors (Case Forming Sheets)

What is claimed is:

1. A case forming, packing, and sealing apparatus comprising:

a cardboard box handling area where case forming sheets are erected into boxes that have openings which open in a direction, products are received into the boxes, and thereafter the openings are closed and sealed; and a product handling area where the products are aligned and a predetermined quantity of the products are pushed in an accumulated state through the openings into the boxes, wherein the cardboard box handling area has an accommodating unit where the case forming sheets are accommodated, a case forming unit that opens the case forming sheets into a square tubular shape, and thereafter closes bottom sides of the opened case forming sheets to form boxes, a first posture changing unit that changes a posture of the boxes to a first posture, a product receiving unit that receives the products into the boxes in the first posture, a second posture changing unit that changes the posture of the boxes so that the openings of the boxes in the first posture face up, and a case sealing unit that closes and seals the openings of the boxes;

the product handling area has a product aligning unit that performs an accumulating operation that aligns the products, and a product inserting unit that pushes the products that have been accumulated into the boxes in the first posture; and the cardboard box handling area and the product handling area are interconnected and mutually independently distinguishable.

2. The case forming, packing, and sealing apparatus according to claim 1, wherein the accommodating unit arranges and accommodates the case forming sheets such that the openings face up when the case forming sheets are opened, the case forming unit moves the case forming sheets upward one at a time forms boxes that open upward, the first posture changing unit changes the posture of the boxes to the first posture so that the openings of the boxes face the product handling area, the product receiving unit lowers the boxes in the first posture, and thereafter receives the products into the boxes.

3. The case forming, packing, and sealing apparatus according to claim 2, wherein the first posture changing unit rotates the boxes by 90° in a conveyance direction.

4. The case forming, packing, and sealing apparatus according to claim 2, wherein a conveyance direction when the case forming unit forms the boxes and a conveyance direction when the case sealing unit seals the openings of the boxes are mutually opposite directions.

5. The case forming, packing, and sealing apparatus according to claim 2, wherein the product aligning unit conveys the products in front of the boxes lowered in the first posture while performing the accumulating operation that aligns the products such that parts of each of the products lie on top of parts of adjacent products in a direction.

6. The case forming, packing, and sealing apparatus according to claim 2, wherein the case forming unit, the first posture changing unit, the product receiving unit, the second posture changing unit, and the case sealing unit are supported by a common frame.

* * * * *